US009434458B2

(12) United States Patent
Macri et al.

(10) Patent No.: US 9,434,458 B2
(45) **Date of Patent: *Sep. 6, 2016**

(54) RESCUE AND RETRIEVAL APPARATUS AND SYSTEM AND METHOD OF USING SAME

(71) Applicants: John G. Macri, New Hyde Park, NY (US); Peter L. Robbins, Great Neck, NY (US)

(72) Inventors: John G. Macri, New Hyde Park, NY (US); Peter L. Robbins, Great Neck, NY (US); Thomas J. Sindle, Staten Island, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/720,191

(22) Filed: May 22, 2015

(65) Prior Publication Data

US 2015/0259056 A1 Sep. 17, 2015

Related U.S. Application Data

(62) Division of application No. 13/885,977, filed as application No. PCT/US2011/061459 on Nov. 18, 2011, now Pat. No. 9,056,661.

(60) Provisional application No. 61/458,196, filed on Nov. 19, 2010.

(51) Int. Cl.

| | |
|---|---|
| ***B63C 9/22*** | (2006.01) |
| ***B63C 9/26*** | (2006.01) |
| ***F41B 11/80*** | (2013.01) |

(52) U.S. Cl.

CPC . *B63C 9/22* (2013.01); *B63C 9/26* (2013.01); *F41B 11/80* (2013.01)

(58) Field of Classification Search

CPC ..... B63C 9/22; B63C 9/26; F41B 11/80; F41B 12/68; F41H 13/0006; F41F 3/055; B63G 9/04

USPC ..... 124/56, 60, 71, 73; 89/1.34; 102/504

See application file for complete search history.

(56) References Cited

U.S. PATENT DOCUMENTS 278,820 A * 6/1883 Reese ..... A62B 1/18 102/504

305,873 A 9/1884 Williams (Continued)

FOREIGN PATENT DOCUMENTS

| | | |
|---|---|---|
| EP | 0873936 | 10/1998 |
| GB | 903198 | 8/1962 |
| JP | 11059585 | 3/1999 |

OTHER PUBLICATIONS

International Search Report (ISR) and Written Opinion of the International Searching Authority mailed Apr. 11, 2012 by the ISA/US in counterpart international application No. PCT/US2011/061459.

(Continued)

*Primary Examiner* — Joshua Freeman

(74) *Attorney, Agent, or Firm* — Abelman, Frayne & Schwab

(57) ABSTRACT

A system is disclosed which incorporates a projectile delivery launcher which may assume numerous forms and perform numerous functions, including launching a water rescue preservation device such as a life jacket, military supplies, survival supplies, fire extinguishing supplies, or the like. The device includes a unique barrel having a low friction chrome plated inner surface which provides maximum range deployment of a safety projectile. In one embodiment a unique clutch-type crank is mounted below the barrel and houses a thin stainless high strength steel ribbon to provide deployment of a projectile, and retrieval of a victim, supplies or the like. A $CO_2$ cartridge system, which incorporates a novel explosive chamber is also used. In another embodiment a compressed gas tank is connected to the launcher for selective release of the gas to deploy the projectile. A method and apparatus for rescuing a victim or for delivering supplies in emergency situations, or even establishing a line contact, is also disclosed.

29 Claims, 16 Drawing Sheets

(56) References Cited

U.S. PATENT DOCUMENTS 2,069,276 A 2/1937 Ryan
2,106,053 A 1/1938 Laingor
2,522,685 A * 9/1950 Mount ..... F42B 12/68 102/504
2,680,593 A * 6/1954 McIntyre ..... A62B 1/10 182/231
2,839,862 A * 6/1958 Hanshaw ..... F41B 11/83 124/27
2,930,584 A 3/1960 Hensley et al.
3,056,395 A * 10/1962 Merz ..... F41B 11/62 124/31
3,065,798 A * 11/1962 Pearson ..... A62C 3/08 102/367
3,102,525 A * 9/1963 Englis ..... F41B 11/83 124/31
3,486,178 A 12/1969 Savage
3,505,926 A * 4/1970 Johnson ..... B63C 9/26 102/504
3,602,661 A * 8/1971 Liedberg ..... B63C 9/24 200/61.05
4,435,455 A * 3/1984 Prewo ..... C03C 14/002 42/76.02
4,439,944 A 4/1984 Johnson
4,582,494 A * 4/1986 Becnel ..... B01J 7/02 441/100
4,799,906 A 1/1989 Perkins, Jr.
5,174,384 A * 12/1992 Herman ..... A62C 31/00 102/504
5,398,587 A * 3/1995 Kornblith ..... F42B 12/68 102/504
5,581,928 A * 12/1996 Krumm ..... C09D 171/00 42/76.01
5,584,736 A * 12/1996 Salvemini ..... B63C 9/26 441/85
5,775,966 A 7/1998 Bautista Real et al.
5,895,300 A 4/1999 Borrelli
5,954,563 A 9/1999 Spriggs
6,120,337 A 9/2000 Bautista Real et al.
RE36,965 E 11/2000 Salvemini
6,379,207 B1 4/2002 Castagner et al.
7,364,486 B2 4/2008 Serpa
7,409,794 B2 8/2008 Triano et al.
7,410,401 B1 * 8/2008 Kasper ..... B63C 9/32 441/80
7,478,680 B2 * 1/2009 Sridharan ..... A62C 3/025 102/368
7,887,382 B1 * 2/2011 Kasper ..... B63C 9/26 440/84
8,550,005 B1 * 10/2013 Olden ..... F41H 13/0006 102/502
2002/0139239 A1 10/2002 Vogl
2006/0059764 A1 3/2006 Triano et al.
2011/0220087 A1 * 9/2011 Gerwig ..... F41B 11/62 124/57
2013/0239937 A1 * 9/2013 Macri ..... B63C 9/22 124/56

OTHER PUBLICATIONS

International Preliminary Report on Patentability (IPRP) mailed Dec. 17, 2012 by the IPEA/US in counterpart international application No. PCT/US11/061459.

* cited by examiner

FIG. 9
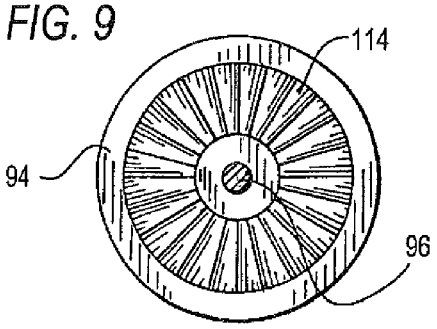
FIG. 10
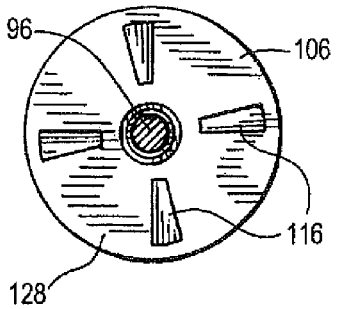
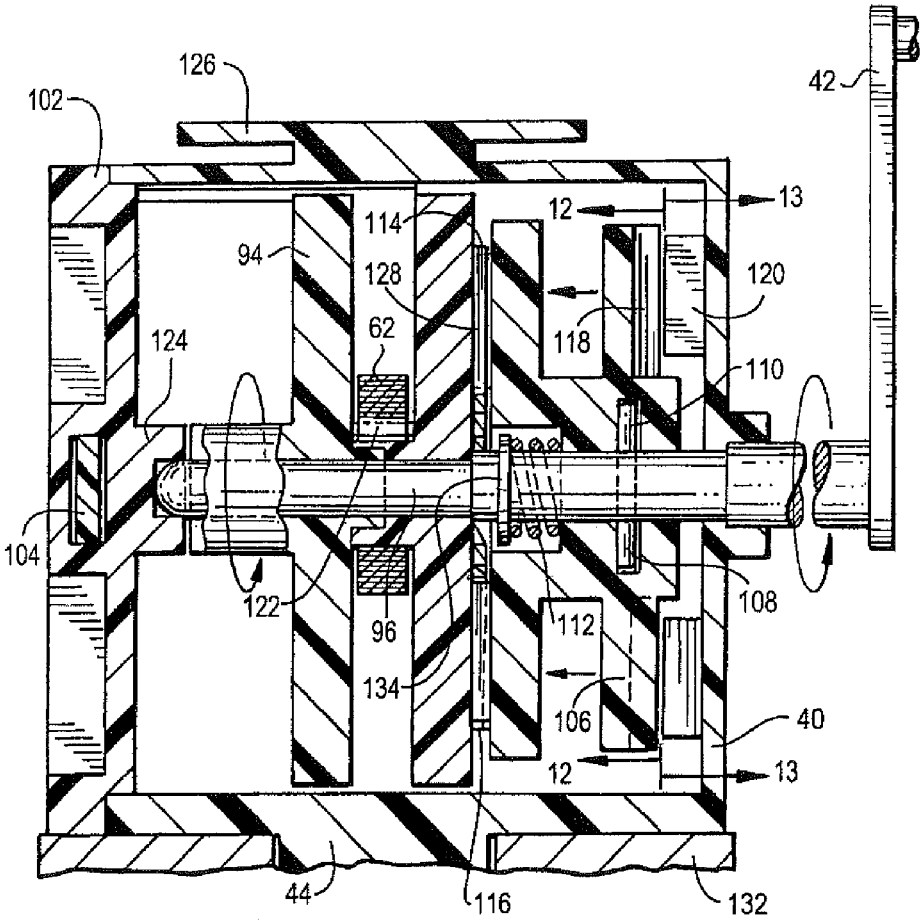
FIG. 11

FIG. 12
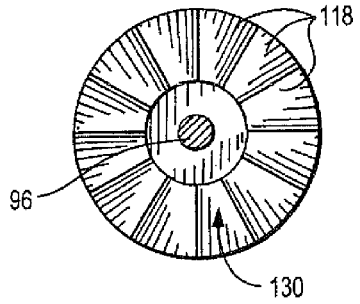
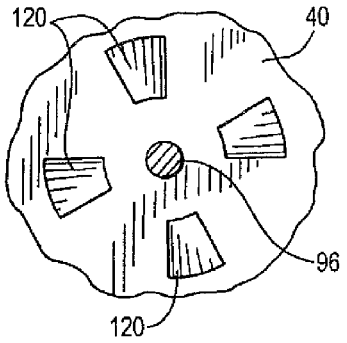
FIG. 13
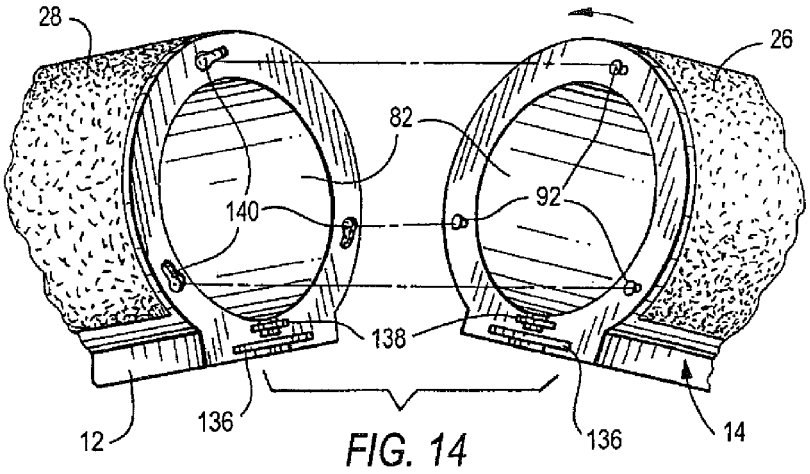
FIG. 14

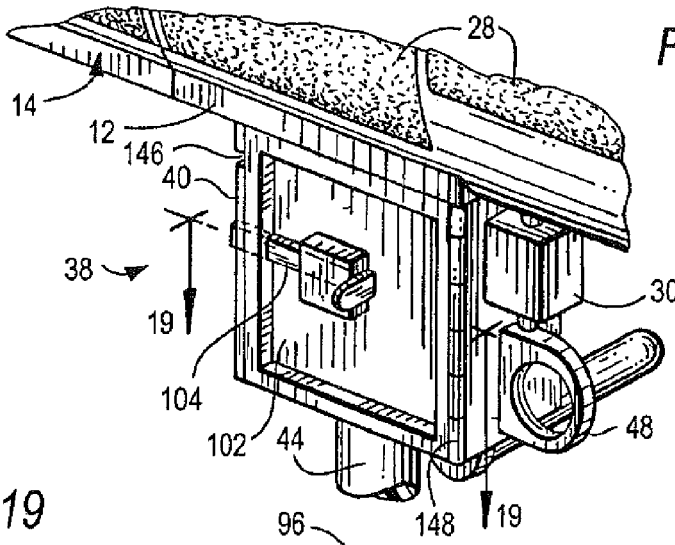
FIG. 18
FIG. 19
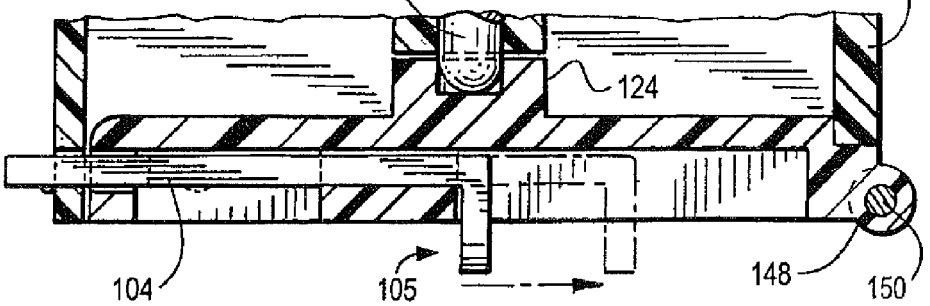
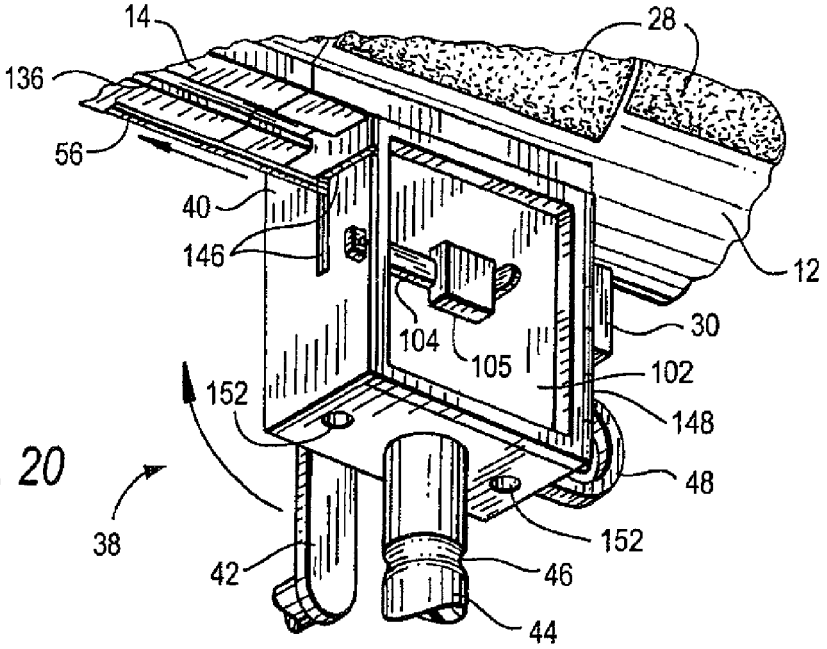
FIG. 20

218
214
206
216

220
218
214

212
36
216
14

10
160
222
214
36

RESCUE AND RETRIEVAL APPARATUS AND SYSTEM AND METHOD OF USING SAME

CROSS REFERENCE TO RELATED APPLICATIONS

This is a divisional of U.S. application Ser. No. 13/885,977, filed May 16, 2013, now U.S. Pat. No. 9,056,661, issued Jun. 16, 2015, which is a 371 of PCT/US2011/061459, filed Nov. 18, 2011, which claims priority to U.S. Provisional Application No. 61/458,196, filed Nov. 19, 2010, the disclosures of which are incorporated herein by reference in their entirety and made part of this application.

BACKGROUND OF INVENTION

1. Field of Invention

The present invention relates to a rescue and retrieval apparatus and system therefor, in the form of a projectile delivery apparatus, which is operable through the use of a $CO_2$ cartridge or any other type of compressed gas supply. In the present application, the apparatus and system are sometimes referred to as the "Quick2Save™ Rescue and Retrieval Delivery System", or "Quick2Save™."

2. Description of the Related Art

Once a person is in danger of drowning or in distress due to a rip current or sudden flood situation, panic sets in and time is of the essence to rescue and retrieve the victim. In a rip current the lifeguard has to maintain eye contact with the victim while swimming to the rescue. This can be extremely challenging, especially when a quick response is needed. Traditional rescue methods would involve a lifeguard jumping down from a lifeguard stand and swimming with a flotation device to retrieve the victim. In a flood situation where the victim is either stranded on a car rooftop, a small land mass or a tree limb, a throw line is often used with repeated attempts to reach the victim. In many cases the victim is too far from the riverbank to reach with traditional rescue methods and helicopters are deployed. These procedures are expensive and create their own set of problems, such as downdraft wash, etc.

Rescue authorities need a way to reach victims quickly, accurately and securely. By the time a call comes into the Coast Guard and they arrive on the scene, precious time is lost and valuable manpower used. The rescue and retrieval capability of the apparatus of the present invention is invaluable. It can be kept in the trunk of rescue vehicles in a hard plastic case so that there is quick access for the police, fire department, lifeguards and military branches.

Also, in military situations troops may need to exchange supplies from one group to another while avoiding entry into a path of danger.

Stranded rock climbers, fireman stranded on rooftops, individuals who fall through the ice of a frozen lake or pond, etc., all need a lifeline or access to a retrieval line to be either pulled to safety or to retrieve life saving equipment and supplies.

The present invention relates to a rescue and retrieval apparatus and system and method of using same, which provides quick and easy access to all of the trying situations outlined hereinabove.

SUMMARY OF INVENTION

The present invention relates to an apparatus and system for rescue of an individual in danger of drowning in water, as well as transferring lifesaving supplies or other equipment from one location to another without endangering either party. Therefore, this apparatus is a rescue and retrieval delivery system for water and land rescue situations.

The rescue and delivery system of the present invention is particularly designed to save lives. The apparatus can reach victims quickly and secure them for safe rescue or retrieval. In a water related rescue and retrieval such as in a lake, beach or river, the apparatus deploys a compacted flotation device inside a canister, and fired from inside a barrel using a blank non-lethal $CO_2$ (i.e., carbon dioxide) cartridge of a well known type. This canister is uniquely attached to a thin stainless steel strip about ⅜" in width, and about 0.0007 inch in thickness. The length of the stainless steel strip is virtually unlimited, and can be provided in any desired length or thickness. The steel strip is then unwound from a reel spool toward the victim as it is transported by the flotation device. Once the flotation device makes contact with the water, a sensor inflates the float using another small $CO_2$ charge and the victim has a secure rescue item to grab. Once the victim has a secure rescue item to grab, he/she can be retrieved using a reel to which the steel strip is attached, and which reel is attached to a housing box of the apparatus.

In an alternative embodiment, in situations that require high volume rescue, the apparatus can be connected to a canister containing a compressed gas supply such as $CO_2$, nitrogen or air, for rapid successive firings of a plurality of such canisters.

Preferably the inner surface of the barrel is coated with a layer of smooth material to produce friction during deployment. Chrome plating is preferred to provide a smooth durable surface. However, a suitable hard and relatively friction-free plastic material such as polyethylene, polypropylene, nylon or the like, can also be used.

Components of the Apparatus—the Rescue Embodiment

The stainless steel housing case contains a thin stainless steel coiled ribbon—or strap, which is approximately 0.0007 inch in thickness and about ⅜" wide, spooled on a retrieval reel and then attached to a flotation device that is rolled and placed in a canister, which in turn is loaded into the barrel of the device for deployment to the victim. Steel strips of alternative thicknesses can be used.

The housing box—or ribbon spool box—will have a handle below it for comfort and accuracy when in the deployment mode. There is a retrieval reel in the housing box when facing the victim and a crank handle on the housing box for same. The top of the housing box is concave to meet the shape of a barrel, so there is a smooth fit where the barrel rests on the housing case.

The stainless steel coil exits the housing case through a mail box-type slot and attaches to a canister containing a folded flotation device provided with an appropriate fastening device for securing the steel strip.

The preferred fastening device consists of a bar having three circular attachment rings, or grommets, attached thereto as will be described hereinbelow. For convenience, hereinafter this releasable fastening device will be sometimes be referred to as a vinculum in view of its resemblance to the well known mathematical symbol "vinculum", defined as a bar drawn over two or more algebraic terms to indicate that they are to be treated as a single term, i.e., "attached".

Once the stainless steel strip is releasably secured to the vinculum on the flotation device it is placed in the barrel from the front for deployment, using a canister placement rod. Once the $CO_2$ cartridge is fired, the canister and float are deployed, towing with them, the stainless steel coil from inside the housing box toward the victim in distress and functioning as a tether. For the embodiment employing a compressed gas supply, the same sequence is followed.

When the float hits the water a small pencil eraser size $CO_2$ charge with a sensor, inflates the flotation device. This is a small charge, yet just enough to inflate a collar on a life vest (or poncho) or a one meter linear float. The life vest or poncho may also have two puff tubes so the victim can further inflate the vest if necessary. Once the victim reaches the flotation device he/she can be "reeled" in with the aid of the stainless steel tether strip on the housing box. An extension pole can be used by pushing a button for the retrieval position.

The retrieving spool is provided with a one-way lock (i.e., clutch mechanism) to prevent the handcrank from spinning out of control when released during a rescue procedure.

The Land Rescue and Deployment Embodiment

As noted, the flotation device can be in the form of a life vest or poncho, or it may inflate into any form which may be grasped by the victim, such as a small raft or log.

For land rescue and retrieval situations (fire dept., military uses) the apparatus can deploy a "dummy" projectile which is simply used to transport the steel strip to the stranded victim. Once the victim receives the dummy projectile, the housing box containing the other end of the steel strip is opened and the needed supply is connected to the deployment end of the steel strip. Thereafter, the needed supply can be retrieved by the receiving party.

The present rescue and retrieval apparatus and system is not intended to eliminate current rescue techniques exclusively. However it can greatly enhance the rescue effort and can make the difference between life and death. Saving minutes in a rescue attempt may save lives.

A rescue and delivery system is disclosed for deploying an object to a predetermined distal location, and optionally retrieving same, which comprises a launching device including an elongated member having an inner cylindrical opening having a generally smooth surface, the cylindrical opening dimensioned for reception of the object to be deployed, a compressed gas deployment system associated with, the launching device and positioned proximal of the object, for selectively providing force to the object sufficient to deploy the object to the distal location, a reel device having a manually rotatable reel member and being associated with the launching device, an elongated flexible member extending into the cylindrical opening and having means at the free distal end for releasable attachment to the object, a proximal end of the flexible member being attached to the rotatable reel member and wound therearound, and upon itself.

Means is provided for activating the compressed gas deployment system to launch the object through the cylindrical opening and to the distal location, whereby the object is at all times during the deployment, tethered to the launching device, and can optionally be retrieved by manually rotating the rotatable member of the reel device, or alternatively released from the elongated member and left to remain in place at the distal location.

The compressed gas system may include a $CO_2$ (i.e., carbon dioxide) cartridge having a sealing and pierceable membrane at one end adapted to be pierced to release compressed $CO_2$, or a large canister of compressed $CO_2$, nitrogen or air.

The object to be deployed may be an inflatable life jacket or a container of supplies.

The launching device includes a hand grip having a trigger mechanism, the trigger mechanism having a trigger device which is arranged to selectively move a piercing member into engagement with the membrane of the $CO_2$ cartridge to activate the cartridge and thereby provide force to the object to deploy the object to the distal location.

The elongated flexible member is a flat, thin high strength stainless steel ribbon, wrapped upon itself into a spool and positioned in a spool box, the spool box having a winding crank and reel adapted to selectively wind the steel ribbon therearound after deployment.

A delivery system is disclosed for establishing a line contact with a predetermined distal location, which comprises a launching device including an elongated member having an inner cylindrical opening having a generally smooth surface, the cylindrical opening dimensioned for an object to be deployed, a compressed gas deployment system associated with the launching device and adapted to selectively release compressed gas proximal of the object, for selectively providing force to the object sufficient to deploy the object to the distal location, a reel device having a rotatable reel member and being associated with the launching device, an elongated flexible member extending into the cylindrical opening and having means at the free distal end for releasable attachment to the object, a proximal end of the flexible member being attached to the rotatable reel device and wound therearound, and upon itself.

Means is provided for activating the compressed gas deployment system to launch the object through the cylindrical opening and to the distal location, whereby the object is at all times during the deployment, tethered to the launching device, to thereby establish line contact between said launching device and the distal location.

The compressed gas deployment system preferably includes a $CO_2$ (i.e., carbon dioxide) cartridge having a sealing and pierceable membrane at one end adapted to be pierced to release compressed $CO_2$ or a canister of compressed $CO_2$, nitrogen or air.

The rescue and delivery system can preferably be used for deploying a folded and inflatable life preserver to a predetermined distal location, and retrieving same, once it reaches a person in distress by drowning, fire, or otherwise. The life preserver can be any type of life preserver such as an inflatable ring, a life jacket or the like.

The rescue and delivery system may also be used for deploying an inflatable life jacket to a predetermined distal location, wherein the inflatable life jacket is folded and contained within a deployment canister.

A method for rescue of a person drowning or otherwise in distress is also disclosed.

A method for establishing a line contact with a predetermined distal location using a launching device of the invention is also disclosed.

BRIEF DESCRIPTION OF THE DRAWINGS

Preferred embodiments of the invention will be described hereinbelow with reference to the drawings, as follows.

Figure 1:
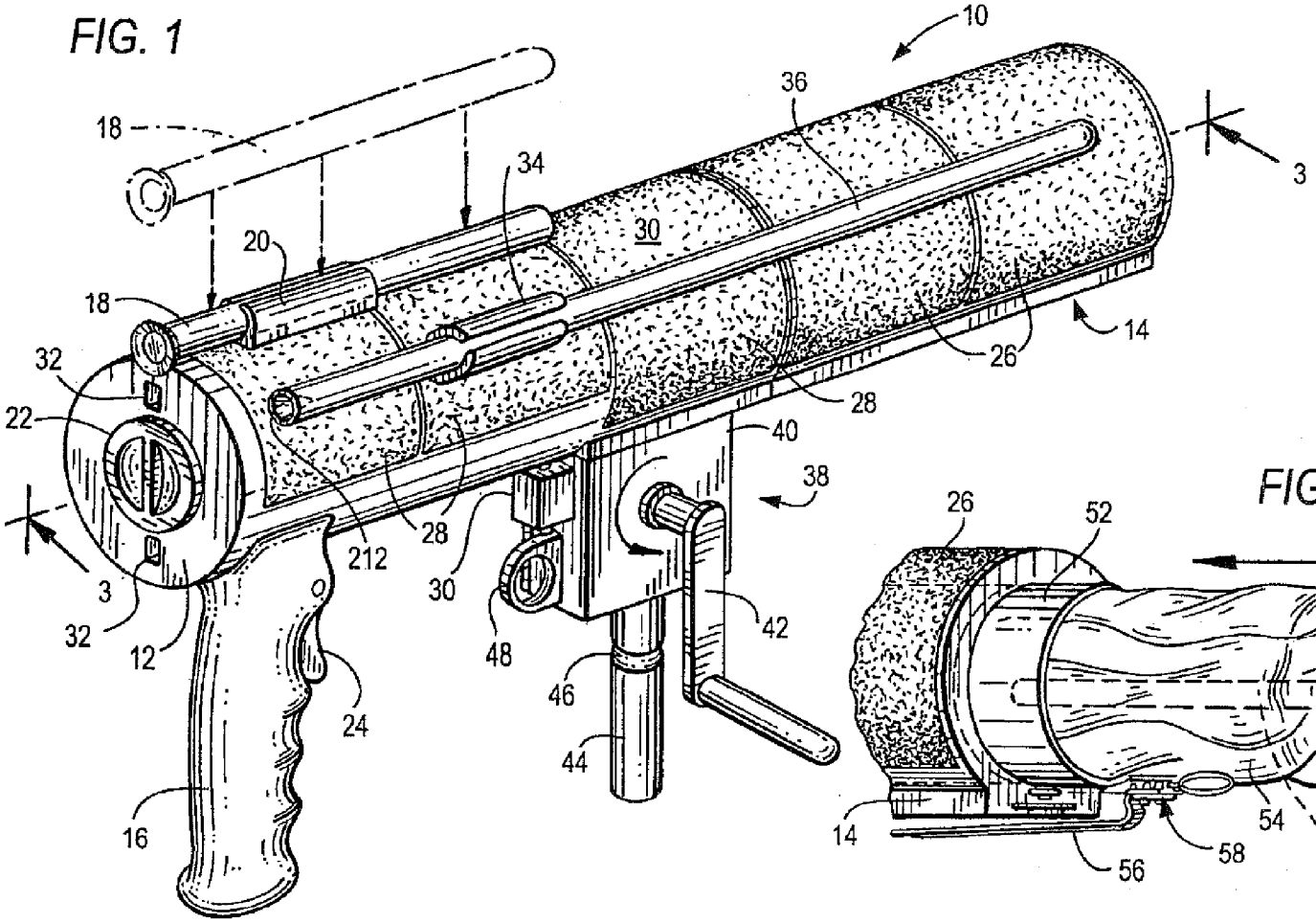
FIG. 1 is an overall perspective view showing a launcher unit constructed according to the present invention, and having a telescope 18, a canister placement rod 36, along with its removable barrel 14. Preferably the inner surface of barrel 14 is chrome plated to make it smooth and to minimize friction so as to facilitate rapid deployment of a life saving device, fire retardants, military or other supplies, or the like. Also shown is the retrieving ribbon chamber 38, and the hand trigger grip 16.
Figure 2:
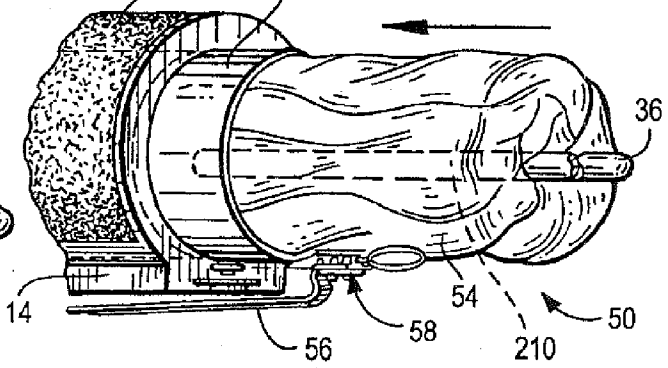
Figure 3:
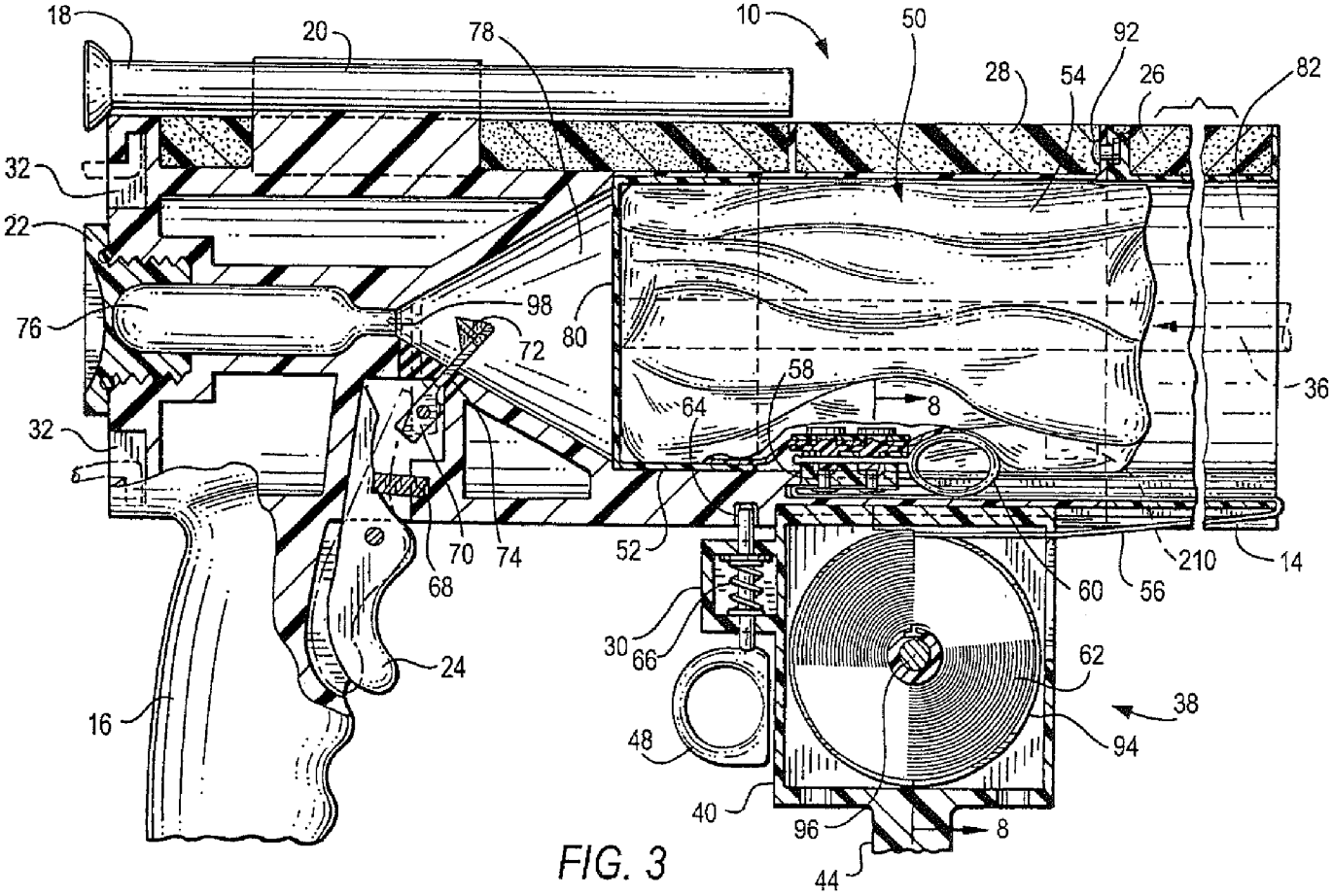
Figures 4, 22:
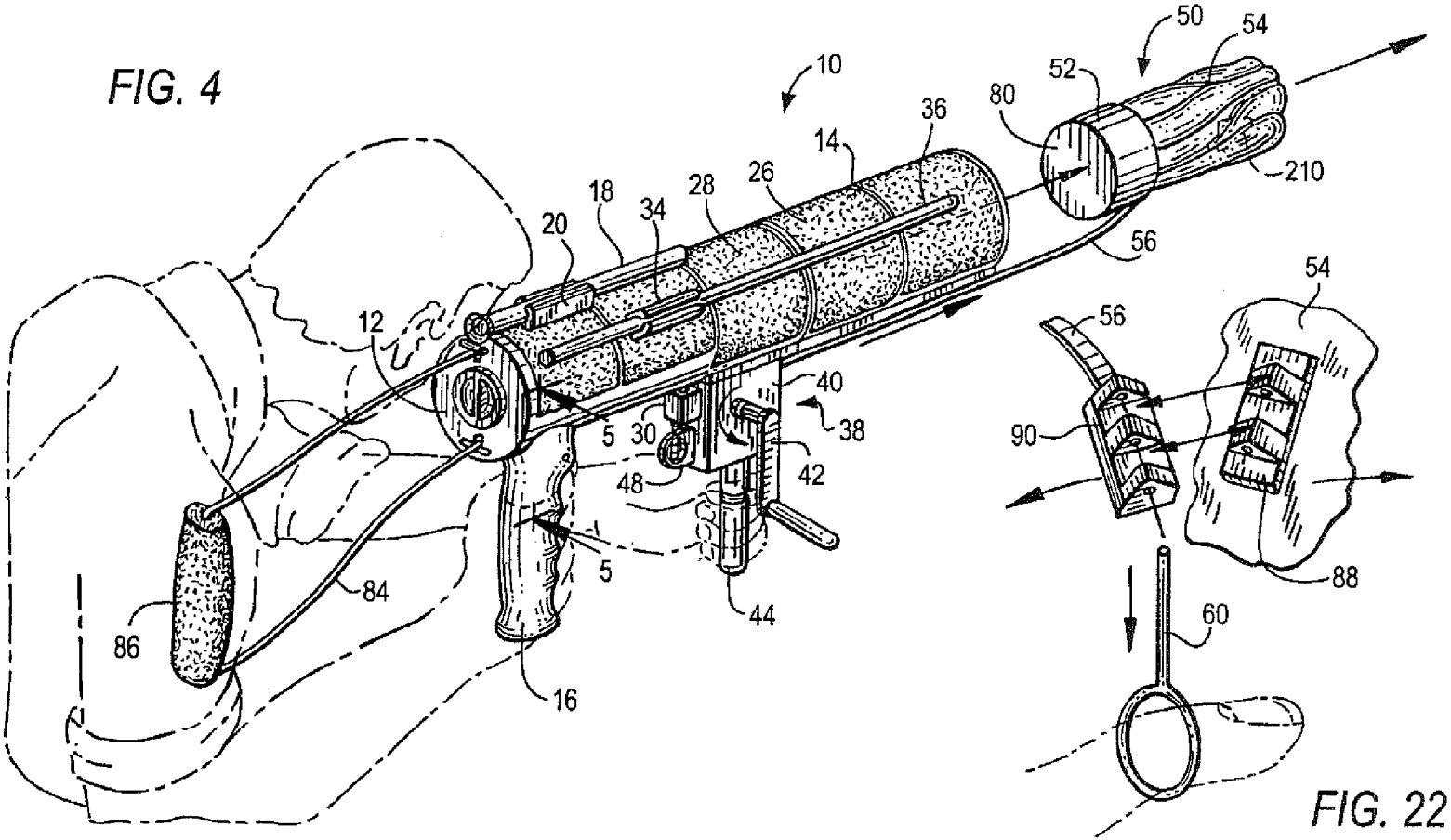

The retrieval reel is just above the left hand which will be used to "reel in" the victim once the victim is secured to the flotation device seen inside the barrel. A scope 18 is used for accuracy and distance. The stainless steel ribbon coil 56 is positioned inside the housing box and can be of varying lengths. For example, a 25 yard rescue will require a 25 yard coil, and so forth, up to a maximum potential of about 125 yards. The steel coil will have the same size center; therefore steel coils of various sizes will fit the retrieval spool equally. A $CO_2$ cartridge is shown and used for the charge to deploy the float. The float contains a sensor that will discharge a small $CO_2$ cartridge containing a charge of carbon dioxide to inflate the float once it is in the water;

FIG. 2 is a perspective view of the front portion of the barrel 14, showing how the canister 50 is inserted into the launcher 10 by using the placement rod 36;

FIG. 3 is a cross-sectional view taken along line 3-3 of FIG. 1. In this view the canister 50 is shown in place, along with its retrieving stainless steel ribbon 56, ribbon spool 62 and ribbon life jacket connector 58. Retrieving ribbon box 40 is also shown. The hand trigger grip 16 also shows the trigger 24 with counter lever 70 with its piercing head 72. Also shown in FIG. 3 is the $CO_2$ cylinder cartridge 76 and the $CO_2$ dispersing chamber 78;

The retrieval reel is seen in FIG. 3 on the right side of the housing box with the spool inside same. The stainless steel coil is shown on the ribbon spool 94, with the strip end exiting the slot at the front of the box to then meet the float inside the barrel of the deployment source. Front door 102 is shown in FIG. 18 to be removable from the housing to permit access to the inside of the ribbon spool box 40 to detach the steel ribbon when required, as described herein;

FIG. 4 is a perspective view illustrating the launcher unit in use. The unit has been adapted with a quick "on-off" butt stock 84, which stock comes with a soft shoulder butt stock pad 86. By attaching this butt stock in a known manner, the user will gain greater accuracy in his aim. Canister unit 50 is shown in flight in FIG. 4, with stainless steel tether in tow, after leaving barrel 14. The canister's life jacket has a water sensitive unit 210. This unit then will inflate the life jacket upon contacting the water. A small $CO_2$ cartridge can also be used to inflate the life jacket upon contact with the water.

Figure 5:
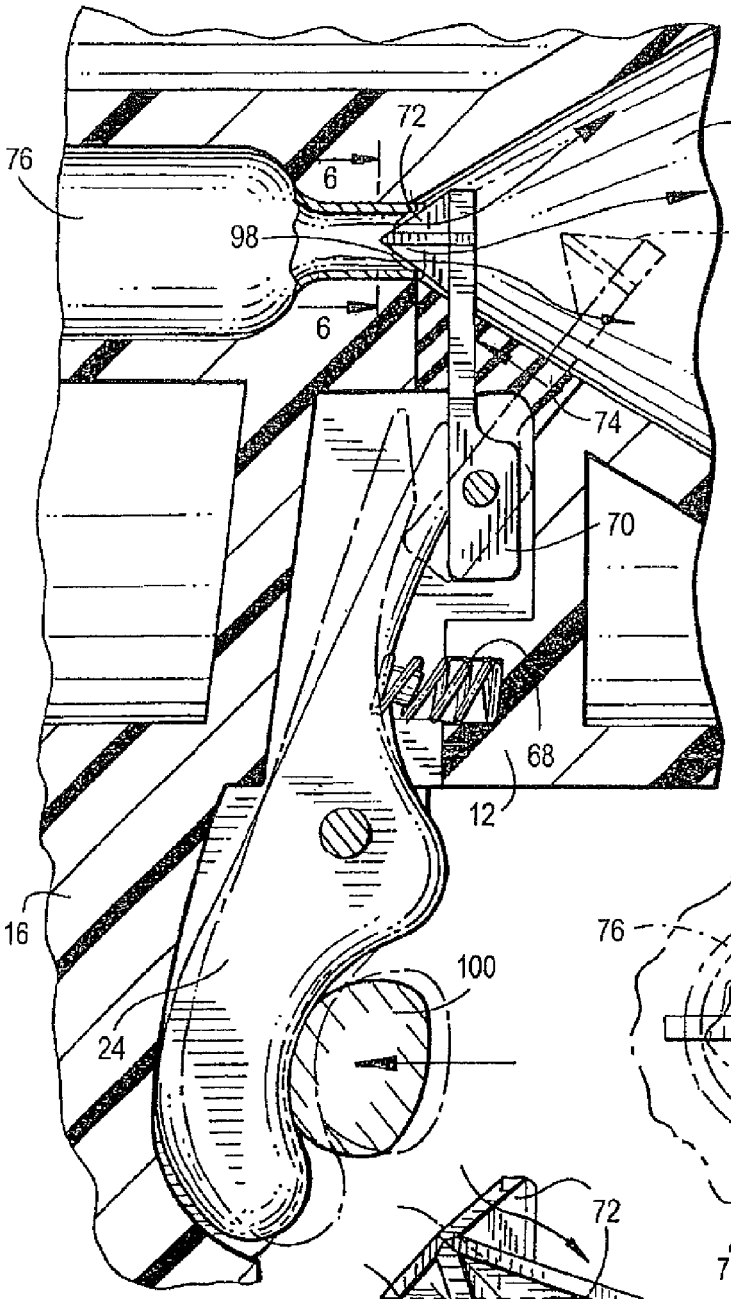
Figure 6:
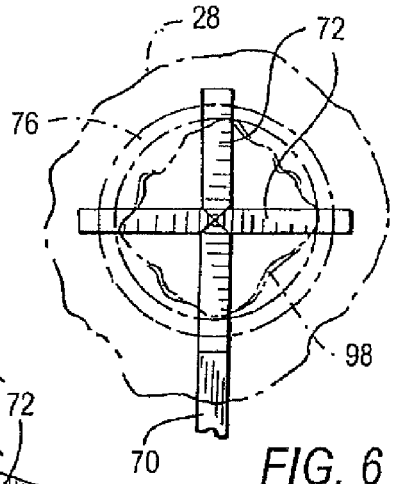
Figure 7:
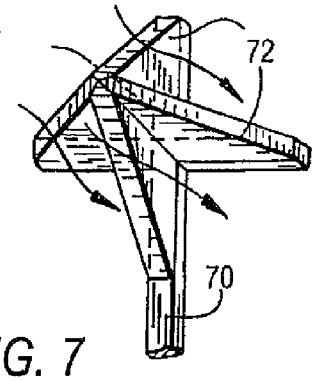
Figure 8:
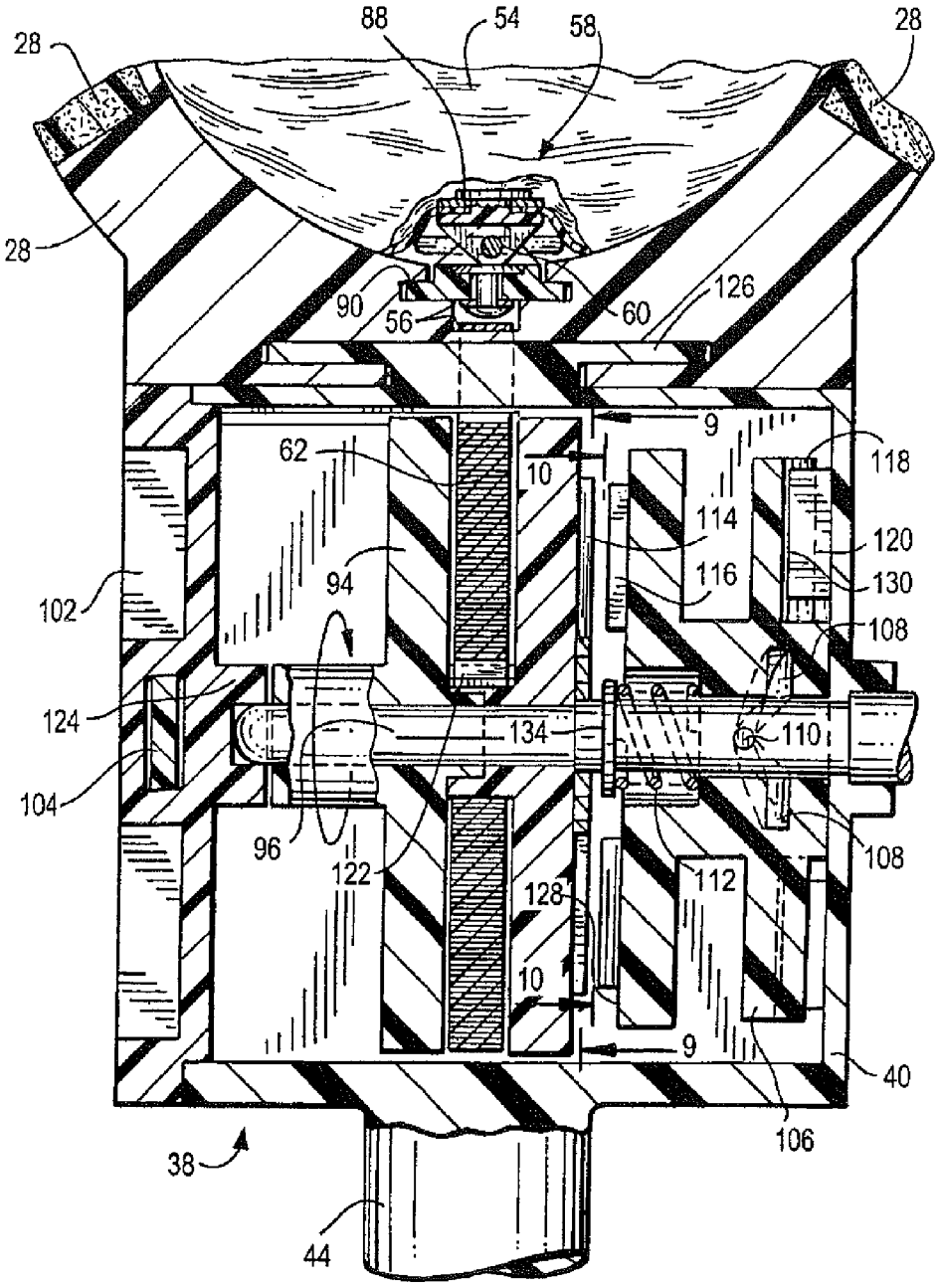
Figures 15, 16:
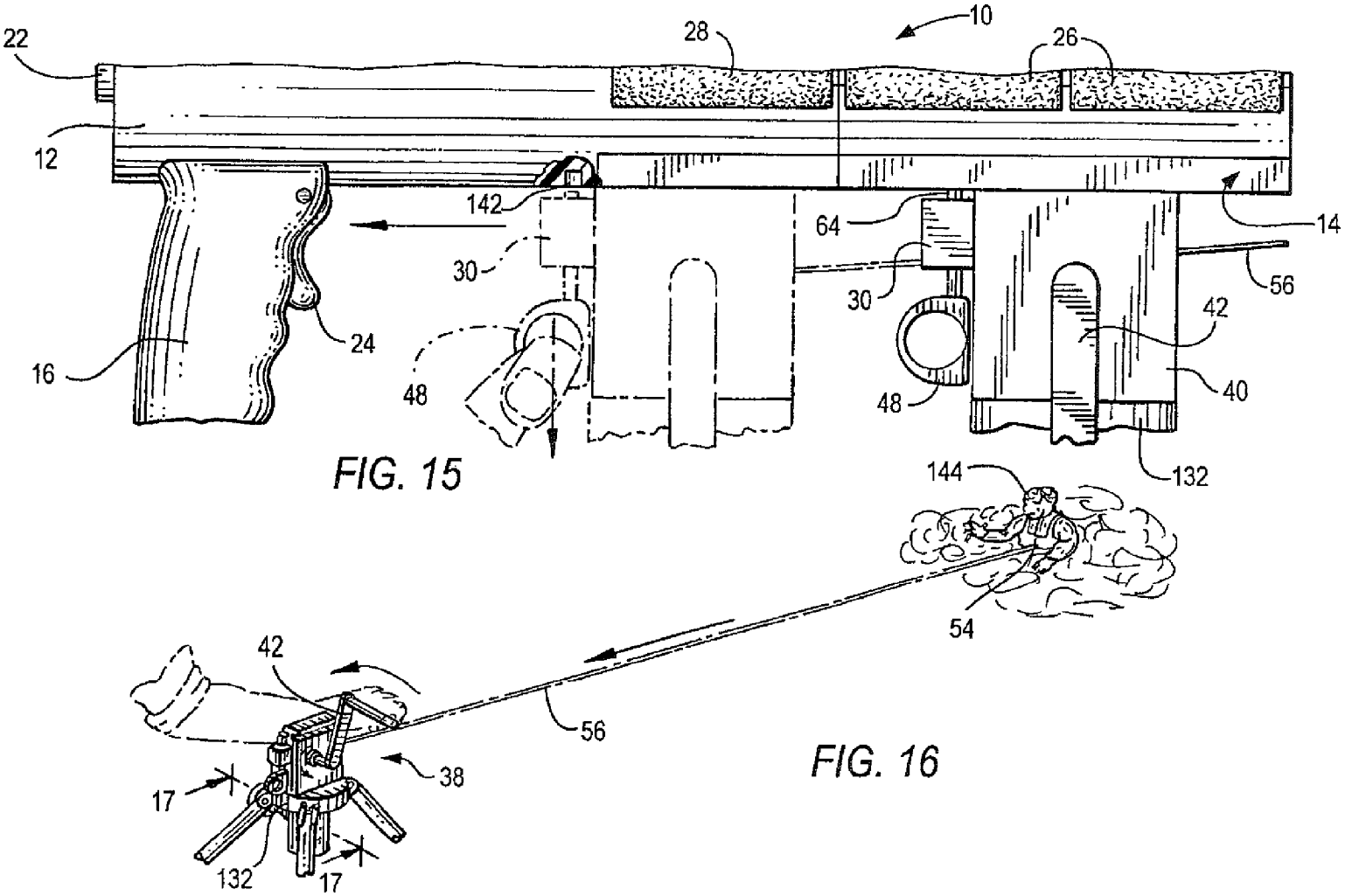
Figures 17, 23:
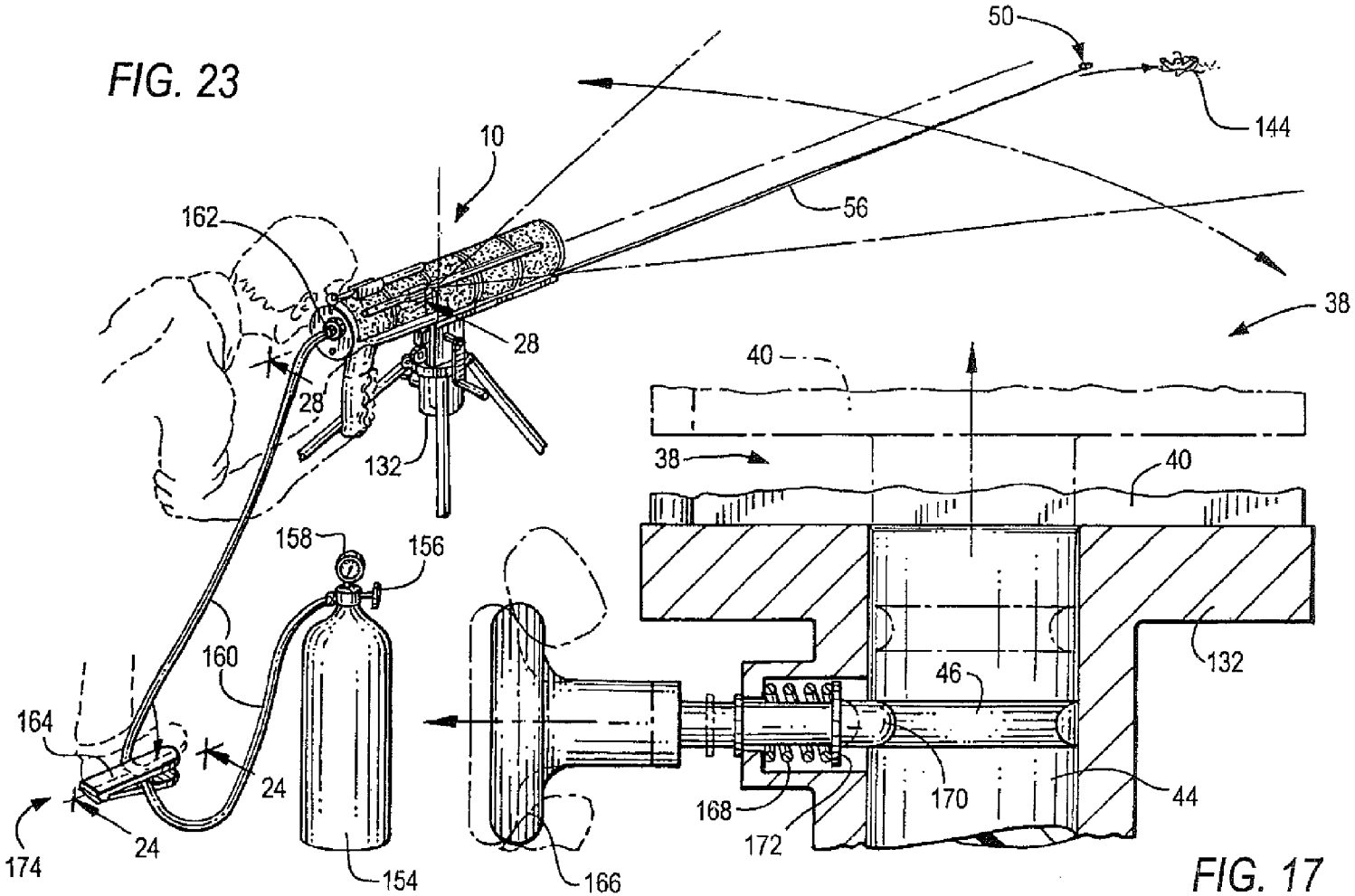
Figure 21:
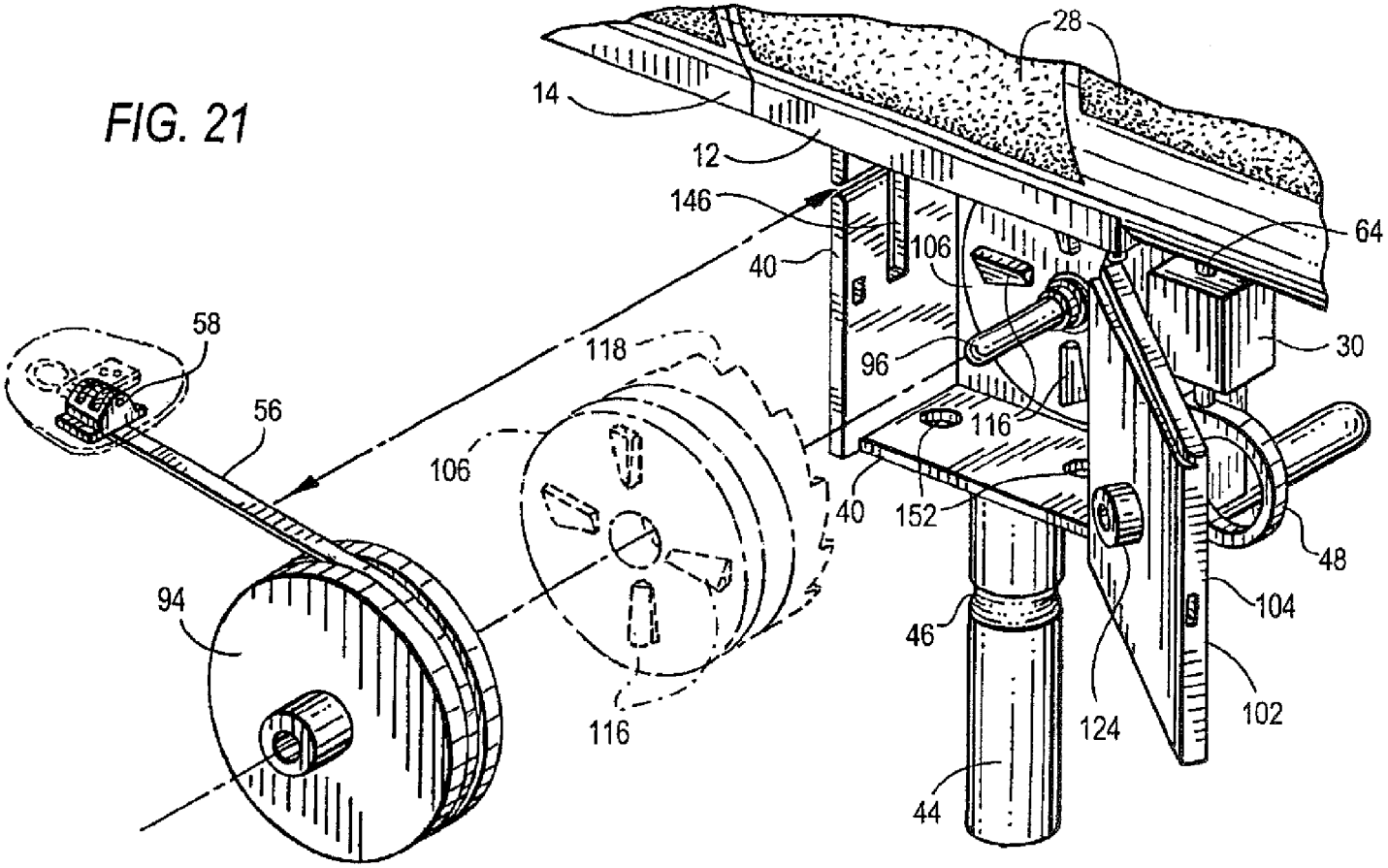
Figure 24:
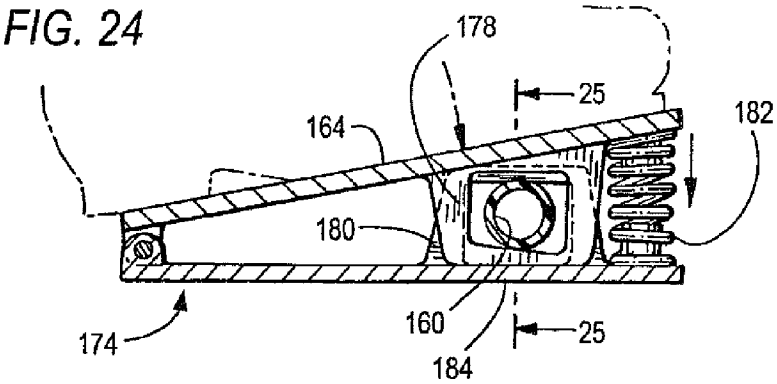
Figure 25:
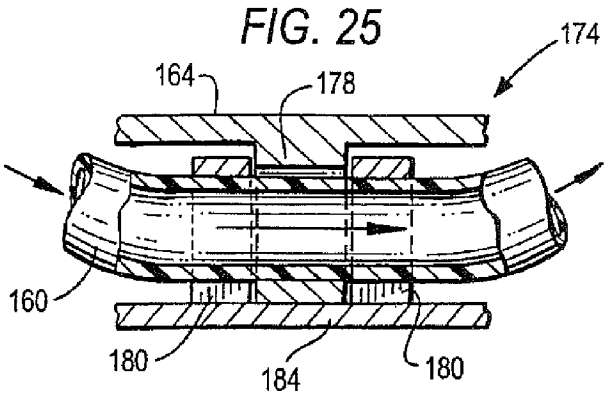
Figure 26:
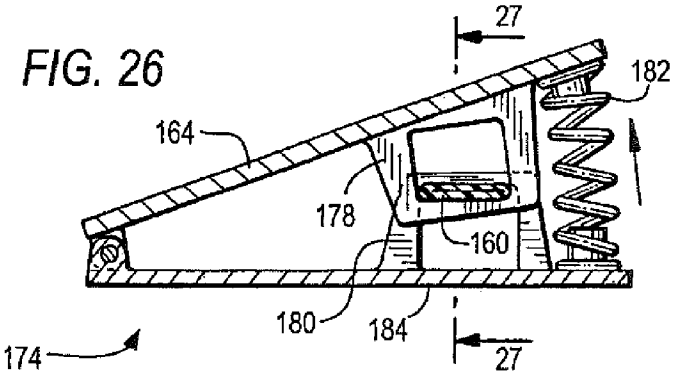
Figure 27:
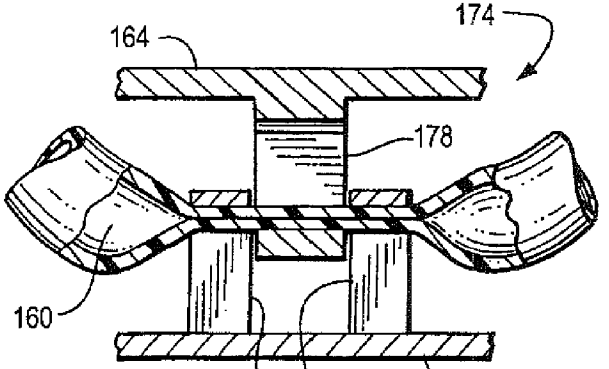
Figure 28:
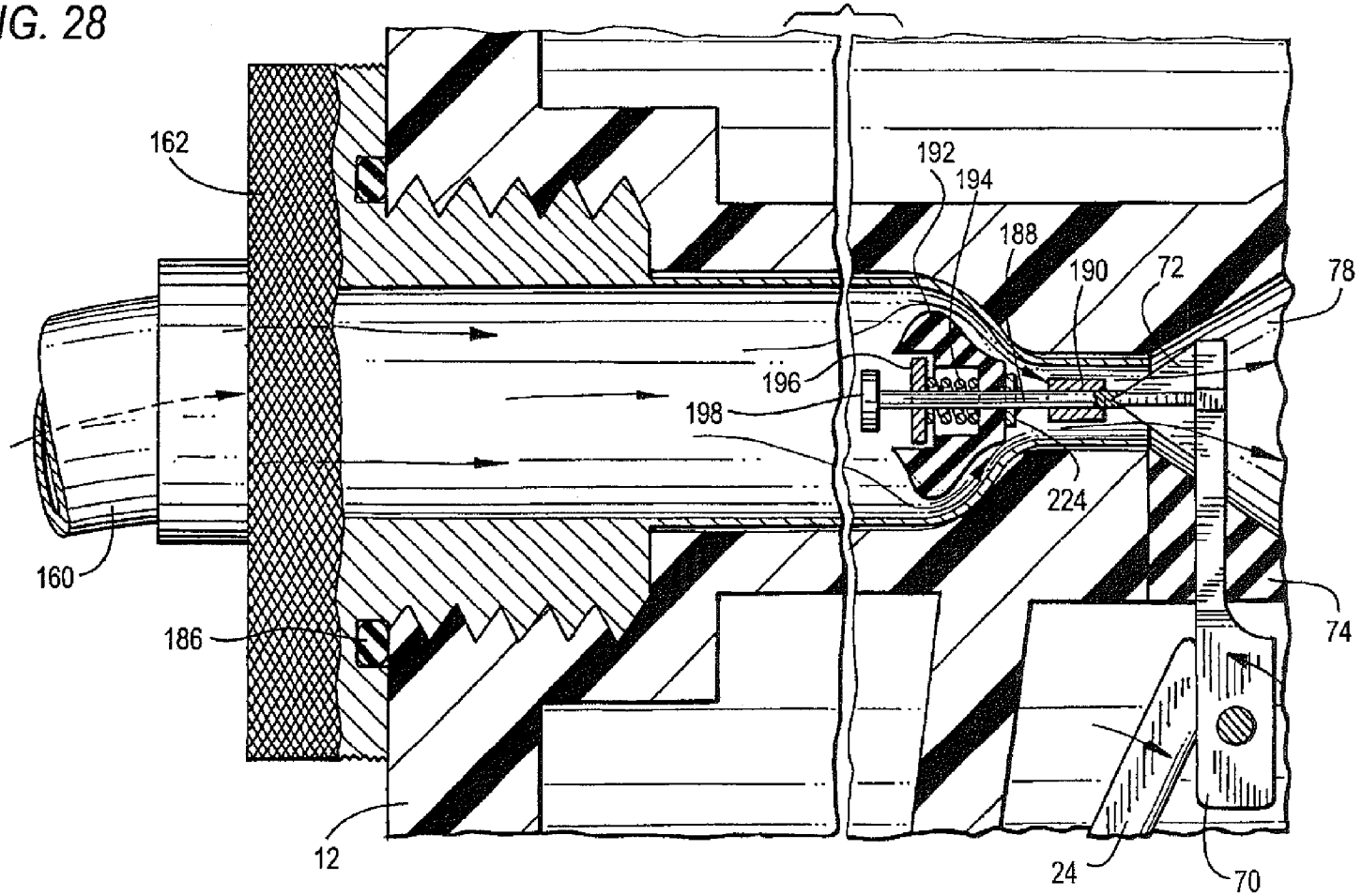
Figure 28A:
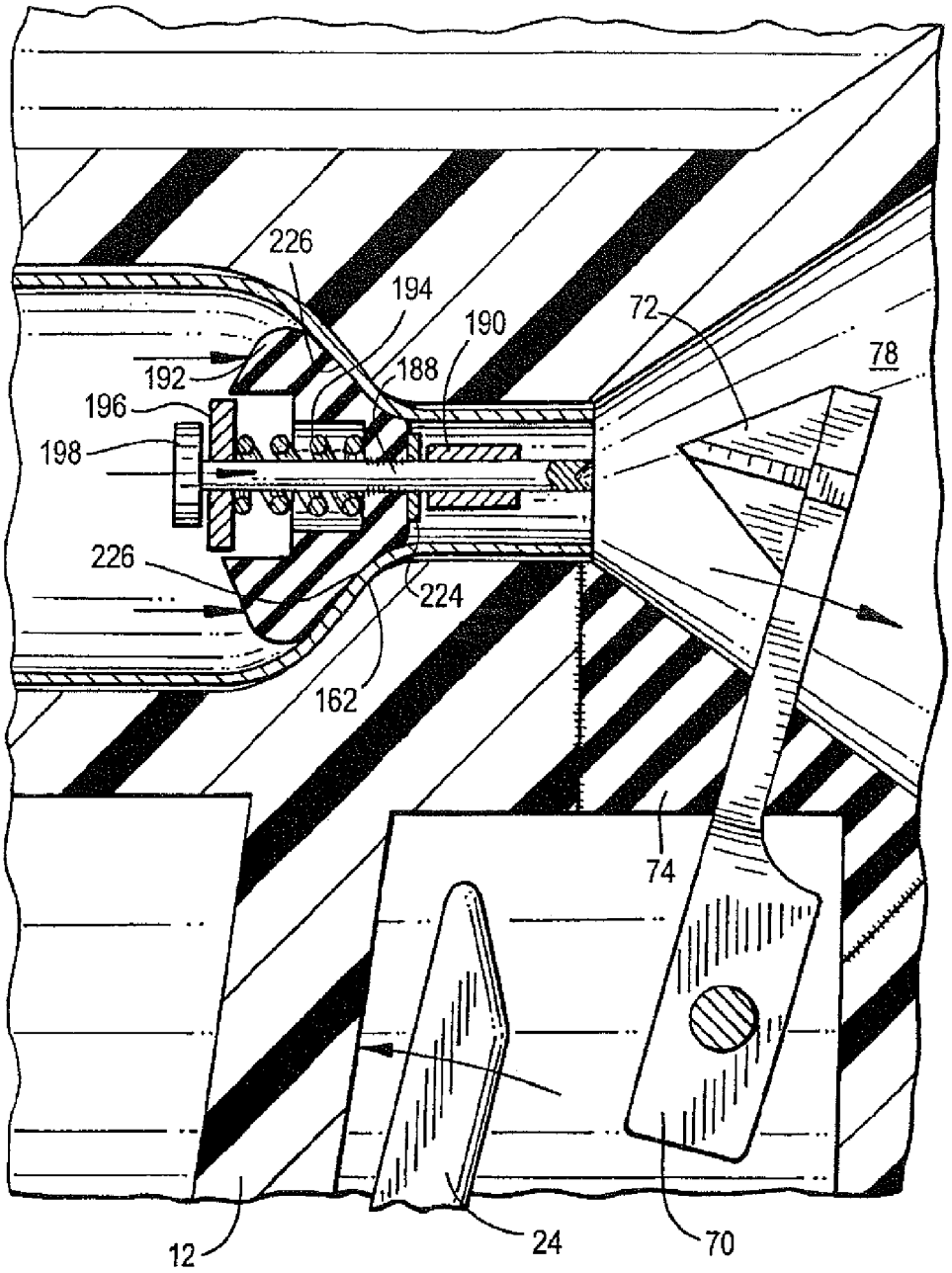
Figures 29, 30, 31:
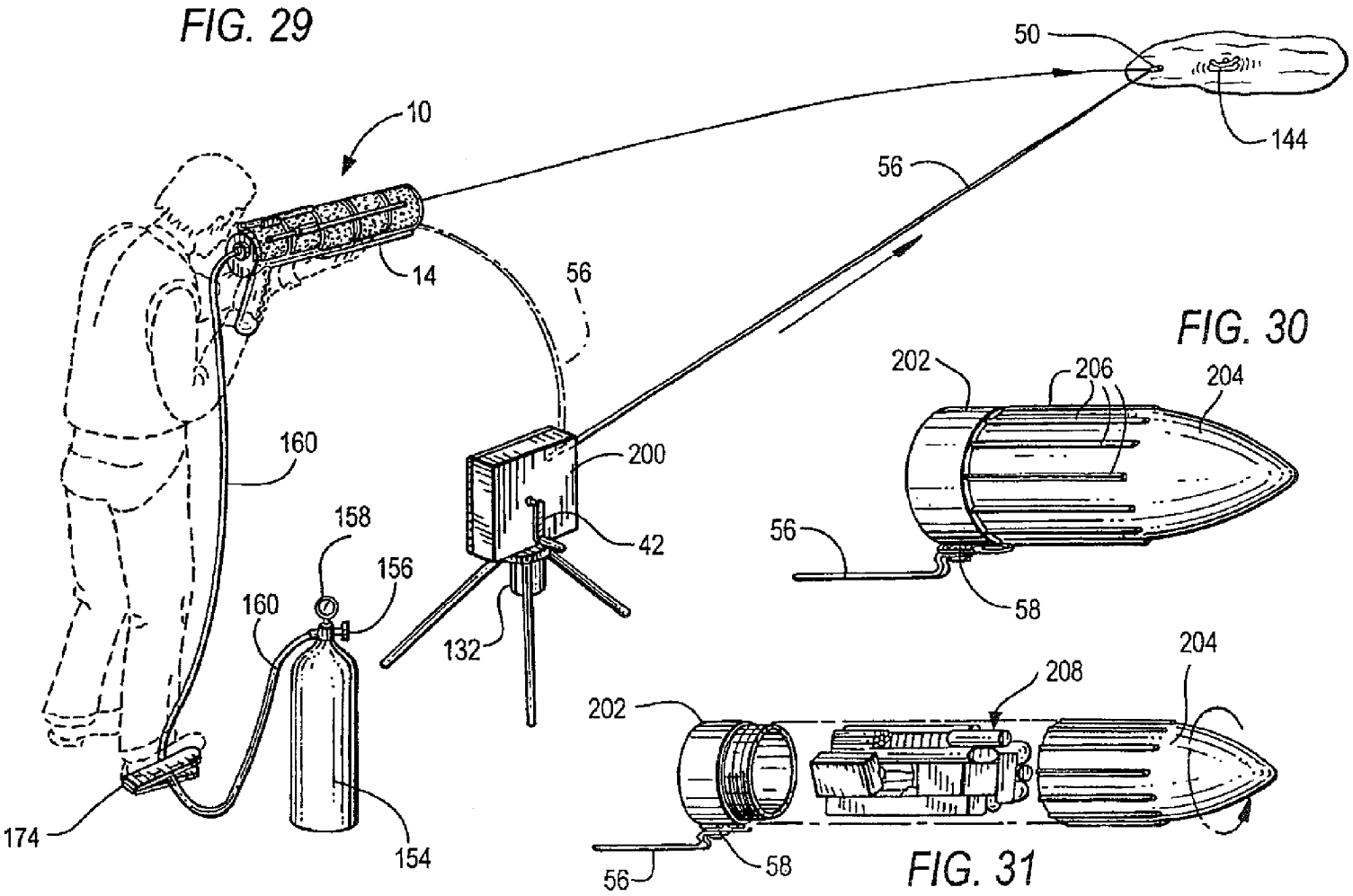
Figures 32, 33, 34, 35:
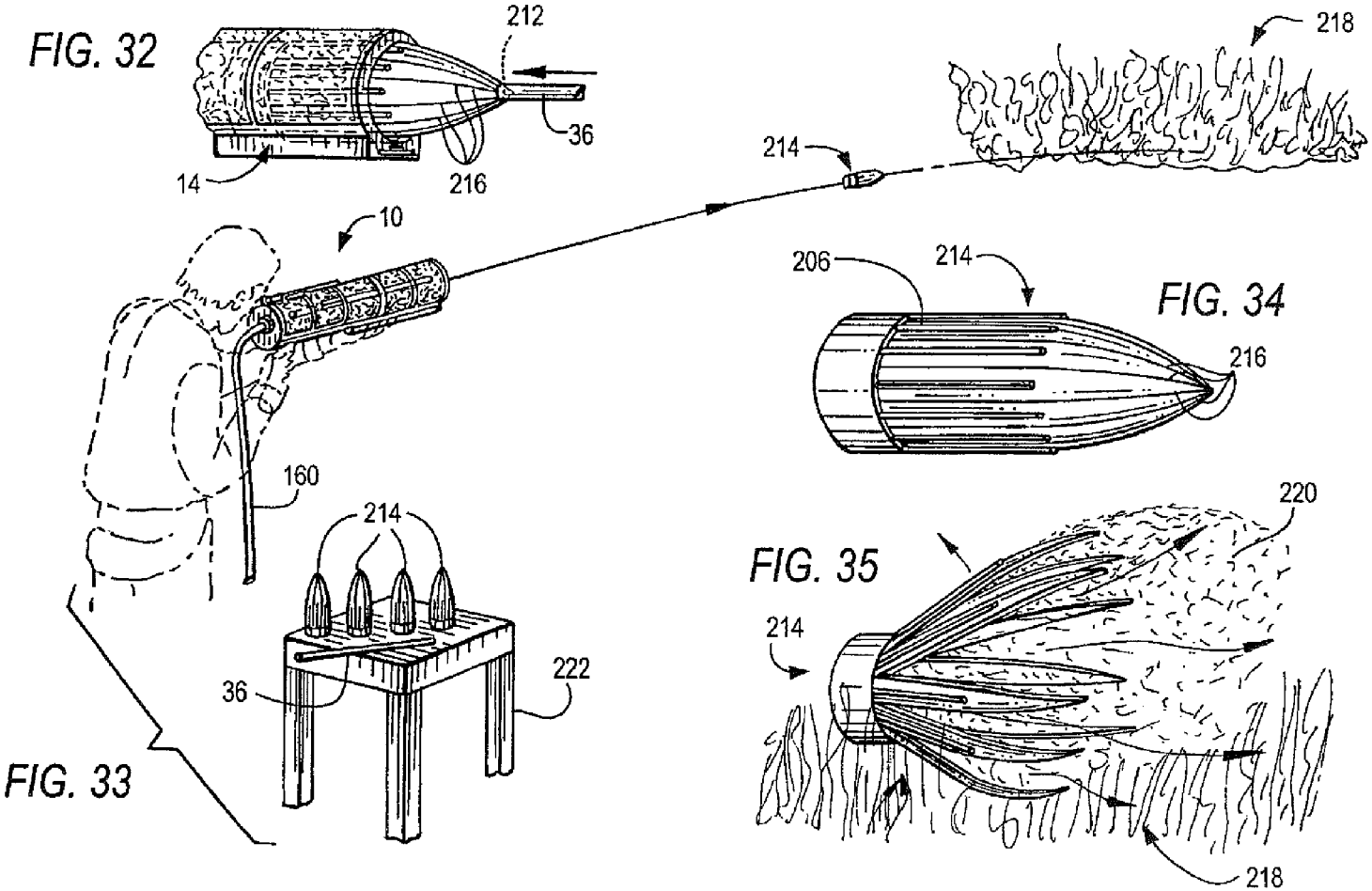

Stainless steel ribbon 56 connects the canister 50 to the launcher 10 as shown. This ribbon 56 is made of a very high tensile strength steel and is capable of pulling heavy individuals or objects. Because of its thinness (i.e., on the order of about 0.0007 inch), this ribbon can be made in very great lengths which can be wound onto a small spool, which takes limited space in the launcher and is light in weight. As a comparison, if a rope were used for retrieval, the rope would not only take up a greater space but would also add greater weight to the canister thereby bringing it down much sooner;

FIG. 5 is an enlarged cross-sectional view, showing how by pulling on the trigger 24 it contacts the counter lever 70, which, having a piercing head 72, opens a seal in the form of a membrane 98 of the pressurized $CO_2$ cartridge, permitting exit of the $CO_2$ gases which can then pass into chamber 78. The $CO_2$ cartridge is filled with pressurized carbon dioxide ($CO_2$). Such type of cartridge is a well-known type;

FIG. 6 is a view taken along lines 6-6 of FIG. 5, looking at the pointed tip of the piercing head 72, piercing $CO_2$ cartridge membrane 98. This view shows that this head is made in the shape of a cross so the escaping $CO_2$ gases can pass uniformly into chamber 78;

FIG. 7 is a perspective view which shows counter lever 70 and cartridge piercing head 72;

FIG. 8 is a cross-sectional view taken along line 8-8 of FIG. 3, showing the releasable ribbon life jacket connector 58. The engaging retrieving spool 106 is shown out of engagement in this view. Furthermore, the ribbon spool 94 is shown freely spinning on shaft 96 while dispensing the tether ribbon 56 in tow, taking with the life jacket canister attached;

FIG. 9 is a cross-sectional view taken along line 9-9 of FIG. 8, and showing the one way locking cams 114 of ribbon retrieving spool 106;

FIG. 10 is a cross-sectional view taken along lines 10-10 of FIG. 8, showing the locking cams 116 of retrieving spool 106, which lock into cams 114 of ribbon spool 94 for retrieval of ribbon 56 along with the victim or supplies attached, as the case may be;

FIG. 11 is a cross sectional view similar to the cross-sectional view of FIG. 8. However, in this view, the ribbon spool box 40 has been mounted onto a tripod stand 132 for better control. When the user starts to turn the hand crank 42, shaft 96 starts to rotate, turning camming pin 110. This movement causes camming pin 110 to move along earning slots 108. This movement in turn, causes engaging retrieving spool 106 to engage return spring 112, which moves to the left, thereby taking engaging retrieving spool 106 out of contact with ribbon box locking cams 120. On the inner face 128 of retrieving spool 106, cams 116 have now come into contact with the cams 114 of ribbon spool 94, seen in FIG. 9. When this contact takes place, ribbon spool 62 can now rotate to bring in the victim, supplies or the like. Should the user let go of hand crank 42, spring 112 will disengage ribbon spool 94 from engaging retrieval spool 106 without causing spinning of the handle, which could otherwise cause injury to the user;

FIG. 12 is a view taken along lines 12-12 of FIG. 11, showing the outer face one way locking cams 118 of retrieving spool 106;

FIG. 13 is a view taken along lines 13-13 of FIG. 11, showing the ribbon box locking cams 120;

FIG. 14 is a partial enlarged perspective view, showing how the barrel 14 can be quickly removed from the launcher control chamber 12 by the use of key slot rivets 92 and, respective mating key slots 140; in addition, the same feature can be used to add optional additional barrels to increase the range of the launcher;

FIG. 15 is a view showing how after the launcher 10 has been placed onto the tripod stand 132, the user then pulls on the release ring 48, which then disengages the lock pin 64 from the launcher control chamber 12 so it can now be removed from the stand 132;

FIG. 16 is an overall perspective view of the launcher and the victim 144 who is being pulled to safety when the spool box or retrieving chamber 38 is on its tripod stand 132 and the hand crank 42 is being turned by the user to retrieve ribbon 56 along with the victim;

FIG. 17 is a cross-sectional view, taken along lines 17-17 of FIG. 16, showing how the retrieving chamber 38 is mounted to the tripod stand 132. Mounting rod 44 is attached to the bottom of ribbon spool box 40. Locking groove 46 is provided on mounting rod 44, into which a lock pin 170 is inserted, as shown. To release pin 170 from groove 46, the user pulls on release knob 166. This movement in turn will release ribbon spool box 40;

FIG. 18 is a perspective view showing the spool box 40 mounted to the underside of the launcher control chamber 12. In this view the spool box front door 102 is shown with its slide lock bolt 104;

FIG. 19 is a cross-sectional view taken along lines 19-19 of FIG. 18. This view shows how the bolt 104 of the slide lock 105 is provided to lock the door 102 to the ribbon spool box 40;

FIG. 20 is a bottom perspective view looking up at the ribbon spool box 40. The two significant features in this view are the relatively orthogonal ribbon slots 146 for lightweight stainless steel ribbon 56, one vertical, the other horizontal. With slots 146, bringing the ribbon into its working position is accomplished with ease by initially sliding it upwardly and then sliding it over to the working position. Also shown are two water drain holes 152. When ribbon 56 is spooled in after being in the water, any excess water can be discharged through water drain holes 152, as shown;

FIG. 21 is a view similar to FIG. 18, illustrating ribbon spool box 40, door 102 open and stainless steel ribbon spool 94 separated to illustrate the ease in which the ribbon spool 94 can be replaced in rapid succession. This view also shows engaging retrieving spool 106 exploded in phantom;

FIG. 22 is an exploded view showing how rapidly the life jacket 54 can be released from the steel ribbon 56 by pulling release pin 60 from jacket mount 88 and ribbon mount 90;

FIG. 23 is a view showing an alternative embodiment in which the overall launcher 10 can be modified by adding an external large compressed gas tank 154 with a pedal unit 174 to achieve a greater distance;

FIG. 24 is a cross-sectional view, taken along lines 24-24 of FIG. 23, showing a foot pedal valve 164 that will provide a backup control of gas coming from tank 154 of FIG. 23. When pedal valve 164 is depressed down, the gas will flow;

FIG. 25 is a cross-sectional view, taken along lines 25-25 of FIG. 24, showing how the foot pedal valve 164 allows compressed gases to expand, and to selectively flow through gas line 160 from the compressed gas tank 154 to launcher control chamber 12;

FIG. 26 is a cross-sectional view of the foot pedal valve 164 in a closed position, clamping off gas line 160. This takes place when the user's foot is removed from pedal 164 and return spring 182 forces pedal 164 upwardly toward the rest position i.e., similar to the well known "dead man's switch";

FIG. 27 is a cross-sectional view taken along lines 27-27 of FIG. 26. This view best shows the operation of pedal unit 174. Gas line 160 is pinched off when outer clamping walls 180 hold gas line 160 and stop it from moving. When inner clamping wall 178 moves upwardly, it pinches the gas line 160 as shown, and prevents the gas from gas tank 154 from reaching launcher control chamber 12;

FIG. 28 is an enlarged cross-sectional view taken along lines 28-28 of FIG. 23. This view shows an alternative adapter which takes the place of the $CO_2$ cartridge 76 shown in the previous embodiment. By using the gas line adapter 162, a greater amount of gas can be supplied to the launcher control chamber 12, and thereby propel the canister unit 50 a much greater distance. In this alternative adaptation, all other parts in the launcher control chamber 12 remain the same. The trigger 24 still hits counter lever 70. Piercing head 72 is also the same as described previously. However, piercing head 72 now engages release rod 188, which will unseat rubber seal 192, allowing compressed gas to flow into dispersing chamber 78 hitting the pressure face of canister 80, thereby sending it to its target;

FIG. 28A is another enlarged cross-sectional view similar to FIG. 28, with an alternative adapter which takes the place of the small $CO_2$ cartridge 76 described previously. In this view, trigger 24 (shown previously in FIG. 3) has been released. When this takes place, counter lever 70 moves back to its start position due to the movement of rubber seal 74 back to its original position. When this takes place, piercing head 72 will disengage release rod 188. Release rod 188 will move to the right, as shown, due to the force of spring 194 bearing against fixed plate 196 attached to rod 188. This action of spring 194 also bears against the inside of rubber seal 192 which is fixed to rod 188 and held in place by lock washer 224 of a known type. Rod 188 is guided in place by plate 196 and holder 190. When rubber seal 192 is moved in this direction by spring 194, rubber seal 192 will come in contact with the inner face of adapter 162 (also shown in FIG. 28), thereby creating a tight seal 226, and thereby preventing any further compressed gas from entering dispersing chamber 78;

FIG. 29 is a perspective view of the hand-held overall launcher 10 of the invention. In this view, an external compressed gas tank 154 is used, with pedal unit 174. However, the enlarged stainless steel ribbon spool box 200 is shown in this embodiment. The provision of a box 200 which is larger in size than the box in the previous embodiment, results in the ability of the launcher to propel the canister a much greater distance; however, but because of its size, the larger spool box must be used with a tripod stand 132;

FIG. 30 is a perspective view showing a different type of canister. A threaded cup 202 is provided with a bullet-shaped head 204 which is provided with splines 206. The bullet-shaped canister head 204 helps to provide the canister with a greater range. The splines 206 reduce friction when passing through chrome plated inner surface of barrel 14;

FIG. 31 is an exploded perspective view of the splined canister head 204, with the threaded canister cup 202 removed from its splined canister head 204 to expose the internal bundled emergency supplies 208. It should be noted that the canister can be filled with any number of types of supplies, including food, water, fire repellants, etc.;

FIG. 32 is a perspective view showing a bullet shaped canister being placed into the removable barrel 14, using the canister placement rod 36 with its depression 212;

FIG. 33 is a perspective view showing the user sending a canister into a fire 218 to extinguish the fire. The overall launcher 10 has no need for a ribbon spool box 40 described in the previous embodiment. The fire extinguishing canister 214 will not be retrieved once it goes into the fire 218, as it dispenses a suitable fire retardant. Once the fire is extinguished, the mission is accomplished. In this view, compressed gas line 160 is also shown. This goes to compressed gas tank 154 as in the previous embodiment. Also shown is a supply of heat dispersing canisters on a table 222. By using the compressed gas tank 154, the user can dispense one canister after another into the fire 218 in rapid succession;

FIG. 34 is a perspective view showing a fire extinguisher canister 214 which has a bullet shape to help give it greater range. It also has splines 206 to reduce the contact surface to reduce friction when passing through chrome plated barrel 14. Cone shaped front portion of canister 214 includes weakened seams 216 which readily separate to dispense fire retardant when it engages the target (i.e., the fire 218); and FIG. 35 is a view showing canister 214 engulfed in a fire 218. When canister 214 hits the fire, the front end portion, which is heat sensitive, will split along its weakened seams 216, allowing its fire extinguishing substance 220 to disburse over the fire 218, thereby extinguishing the fire.

DETAILED DESCRIPTION OF THE PREFERRED EMBODIMENTS

FIG. 1 shows an overall perspective view of the launcher unit of the invention, including chamber 30 which is covered with a buoyant from material for flotation purposes in the event it falls into water. Removable extender barrel is releaseably attached as shown in FIG. 14, by rivets 92 and key slots 140. Additional foam coated extension barrels may be added, depending upon the desired range of fire.

The Quick2Save™ device is housed in a stainless steel box and contains a stainless steel coil ⅜ inches wide and 0.005 inches thick. In the preferred embodiment, the stainless steel ribbon 56 has an isoelectric point of 8.8 and is comprised of Fe 203, Fe 304 and Cr 203. It is non-corrosive and has tremendous tensile strength, needed for the retrieval of a drowning victim. One preferred supplier of the steel is Bokers Corp., located in Minnesota (USA). Other specifications are contemplated.

Referring now once again to FIG. 1, attached to the ribbon spool box 40 is a ribbon spool 62 and grip handle 44. Hand crank 42 operates the ribbon spool 62. The stainless steel ribbon 56 exits the ribbon spool box 40 at the top of the box 40 as shown. The steel ribbon 56 connects to the canister cup, which can contain either a one meter linear float or a poncho/vest with inflatable collar. The collar or linear float inflates with a small $CO_2$ charge roughly the size of a pencil eraser. As noted previously, this connection is made through a vinculum, previously described. DuPont Corp. is one example of a preferred supplier of the Softesse®/Suprel® brand nonwoven material used for the flotation device. The housing box will have a slide lock bolt 104 as shown in FIG. 20.

FIG. 21 is a perspective view of the opened housing box 40 for the Quick2Save™ delivery system. There is a hinge 148 and latch lock 104 (i.e., slide lock bolt) which allow for easy opening and secure closing of the steel coil which is placed through the center onto a ribbon spool shaft 96. Mailbox-type slots 146 are provided, through which the stainless steel ribbon 56 passes, to be connected to the flotation device before it is placed in the barrel 14.

The floatation device will be fluorescent yellow or other bright color. It will be labeled for rescue, and once the victim is secured, it will be in the retrieval position. The float has an inflatable collar. It will have puff tubes for a person to blow into if they are able, to further inflate the poncho/vest. The collar will inflate via a $CO_2$ charge and will secure the victim. The puff tubes (B1) provide additional protection and recommended for use.

FIG. 22 illustrates the technology for connecting the float to the stainless steel strip. The preferred technology for connecting the stainless steel strip to the flotation device is via a vinculum. As noted previously, the vinculum contemplated herein is a straight bar above three stainless steel washer-like rings (or grommets) which provide extra strength and ease of attachment and detachment, especially when the victim is being retrieved. The stainless steel ribbon 56 will connect to the ribbon half mount 90, as shown, to jacket ribbon half mount 88 as shown.

FIG. 11 is a cross-sectional view of the ribbon spool 40 of the invention, illustrating the inner workings of the retrieval system and ribbon coil. This view shows a pawl and the gear-type clutch system used to prevent the hand crank from unwinding when in the rescue mode, the hand crank being removable for purpose of releasing the steel ribbon when in the retrieval mode, prior to attaching supplies, etc. to the inner end of the steel ribbon. Dupont Corporation's material fabrics may be used for the flotation device. Softess® or Suprel® is the product being considered. Other similar thin, strong waterproof materials may also be used.

It is significant to note that the article to be deployed can be a life jacket or any article. Once the contact has been made between the launcher and the distal location, any article such as supplies, medical needs, or the like can be conveniently placed on the stainless steel ribbon and transported by sliding or otherwise to the distal location, or in the opposite direction, i.e., to the launcher.

Quick2Save™ is a unique rescue delivery system that is non-lethal and can be utilized by most shotguns, air cannons and flare guns. Quick2Save™ deploys a tightly coiled non-corrosive ⅜" wide stainless steel ribbon discharged by a $CO_2$ cartridge and connected to a float via a vinculum, or other suitable releaseable fastener. A collared or linear float inflates on impact using a $CO_2$ charge with any type of well known sensor. There are three companies that can manufacture the steel coil; i.e., Boker's, Inc. of Minnesota; Iscar of Israel; and Arcelor Mittal of the Netherlands.

With regard to the inflation device, DuPont can manufacture the material and the float. Puff tubes can enhance the inflation of a collared float/poncho or other life preserver. The stainless steel coil remains connected to the spool inside a housing case to retrieve the victim. A blank charge fires a stainless steel coil strip that once deployed, can also be used as a line to attach such items as life jackets, vests etc. Quick2Save™ can also be used with a compressed gas supply where compressed gas deploys the steel coil along with a flotation device. The invention affords the luxury of a wider barrel (3¼ inches) thus enabling a larger float to be inserted. The float can either be a collar-type float like one that falls down from an aircraft cabin in the event of a loss of cabin pressure, or a one meter linear float. The steel coil will fit on a retrieval spool for easy retrieval of a victim after the victim is secured.

A fluorescent die pack can also be attached for night rescue. The inventive device can fire other first aid items without the steel strip to get items to the victim immediately. Various floats can be deployed using the present invention. All flotation devices will have a $CO_2$ charge with a sensor that inflates the float when it hits the water. Some floats are radar detectable for night rescue.

Quick2Save™ has worldwide application for rescue in oceans, lakes, rivers even frozen lakes and ponds when a victim falls through the ice. The rescue operator can deploy the steel ribbon coil rather than walk on the ice risking additional life. The steel ribbon coil is extremely durable, non-corrosive and can be used to pull a victim from the water or ice.

Once deployed, the Quick2Save™ device can reel in the victim using the attached reel and left hand grip. There can also be an extension pole for support against the retriever's waist or ground to assist in the retrieval of the victim. Rescue items can also be deployed without the stainless steel coil if retrieval is not the immediate concern.

Current rescue methods require the rescuer to throw a ring attached to a rope. However, the rope is not very accurate and can only be thrown a short distance. The stainless steel coil is accurate and has a range of 25-125 yards offering an assortment of coil sizes to conform to any rescue situation. In the case of the Coast Guard or any marine rescue agency, it is advisable to have coil sizes with various distances to handle any emergency that arises. The device offers the greatest distance in the effort to save a life and should have a scope attached. The float will inflate on impact via a $CO_2$ charge to approximately one meter in length and it will preferably be linear in shape. A collared float with a poncho/inflatable vest can be used and it can be radar detectable.

Potential users of Quick2Save™ would be the US Coast Guard, Navy, Merchant Marine, Army, any marine patrol, local police (first responders), fire departments, and lifeguards, etc.

Quick2Save.com, Quick2Save.net and Quick2Save.org have been secured by domaines.com.

Using the same Quick2Save™ concept, a first aid kit can be deployed up to 900 yards or greater, without a retrieval line however, still getting life saving equipment to victims of disasters quickly. Sep. 11, 2001 (9/11) is only one example of such disasters.

Quick2Save™ is not only applicable to water rescue or ice rescue. It is as valuable as retrieval or exchange line as it is in water attached to a flotation device (see examples of Quick2Save™ usage in the summary section, supra). Training and certification may be required by any users of Quick2Save™. The training can be done at a local Coast Guard station where a certification number registers each user. Lifeguards may have this as part of their certification training as well. "A first responder is a trained responder."

Quick2Save™ is a rescue and retrieval delivery system designed to save lives. It is intended to reach victims quickly and secure them for safe rescue. Currently if a person is in a rip current and in trouble 75 yards offshore, a lifeguard has to swim to the rescue. This is difficult, with a strong current, especially trying to see the victim while the lifeguard is swimming. Quick2Save™ offers a quick solution. The launcher deploys a compressed flotation device which, once fired, unwinds the stainless steel coil from the reel spool inside a housing box. Once the flotation device hits the water it inflates using a $CO_2$ charge and secures the victim for retrieval.

This method is not intended to replace current rescue methods. However, it can clearly enhance the rescue effort and can make the difference between life and death. Saving seconds in a rescue situation saves lives. The Quick2Save™ method can be used for any water rescue, ice rescue and any land retrieval emergency. Quick2Save™ is not just a retrieval device for water or ice rescue. It is a lifeline for exchanging or delivering life saving equipment by attaching the items to the inner end of the stainless steel ribbon for retrieval by the victim. Once the stainless steel ribbon is deployed, the inner end is removed from the barrel of the launcher and the equipment is attached to it so that the receiving party can retrieve it. Even if the steel coil ribbon isn't used at all, this rescue and delivery apparatus can reach victims instantly with life saving equipment in many different emergency situations. The stainless steel strip is the retrieval lifeline that will bring the victim to safety or transfer needed supplies from place to place. It is therefore a very valuable tool for these reasons.

Examples of the Quick2Save™ Application

1) Water rescue—a flood victim stranded in a river on a car roof or island can now be reached. The steel coil can be used to exchange life saving equipment in an emergency. For example, an individual is on a car roof in flood waters 50 yards off the bank of the river. Quick2Save™ can deliver a flotation device or a just a dummy weight just to reach the individual. Once the individual has the floatation device or dummy weight he/she can hold onto it while at the other end, the rescue person detaches the stainless steel coil from the spool and clips a life vest to the end of the coil. The stranded individual then tows the stainless steel strip toward him/her and retrieves the life vest. Once the life vest is on, another steel strip is deployed to rescue the individual. All of this can be accomplished from the bank of the raging river. The Quick2Save™ Rescue and Retrieval Delivery System could be standard equipment for every emergency service agency; e.g., police, fire dept., EMS, Coast Guard, Merchant Marine and Navy.
2) Fire rescue—a fireman is 6 stories high on a rooftop and can't be reached due to flames shooting out of the windows of the burning structure. Quick2Save™ can shoot a dummy weight up to the rooftop. Once received, the firefighter can retrieve any necessary equipment. The rescue operator of the launcher simply opens the latch on the housing box containing the steel coil, and attaches the needed equipment to be towed to the rooftop by the firefighter. Even the nozzle of a fire hose can be pulled to a rooftop while being connected to the truck at the other end, giving the firefighter a useful water hose. This would be impossible at the present time as most truck ladders have a maximum reach of six stories.

Fires can be extinguished by deploying a suitable fire retardant in a canister, such as a double-walled cylinder. Materials contemplated for such fire extinguishing tasks include sodium lauryl sulfate, ammonium phosphate, monoammonium phosphate or ammonium sulphate. Also contemplated is a chemical known as bromochlorodifluromethane, which is marketed under the trade names Halon 1211, or BCF, or Halon 1211 BCF, or Freon 12B1. This chemical is a halo alkane with chemical formula $\underline{CF_2CLBr}$.

3) Ice rescue—a child falls through the ice and is in immediate danger. A police officer goes into his trunk to utilize Quick2Save™. He/She deploys a float to the victim and because of the tensile strength of the stainless steel, the victim can be reeled or pulled to safety without jeopardizing any additional lives. Pulling the stainless strip by hand will not cause cuts since the edges of the steel are rounded. Protective gloves may be helpful if pulling the steel strap by hand. There are eight states bordering the Great Lakes and Canadian provinces. Quick2Save™ will be particularly useful in these locales, as well as Canada and worldwide.
4) Rock climber stranded—a dummy projectile can be deployed to reach the victim and a zip line can be attached to the steel strip and can be towed to the stranded victim and he/she can be rescued safely.
5) Military—two soldiers are 50 yards apart behind a structure. A first soldier runs low on ammunition. The second soldier fires a dummy projectile carrying the stainless steel coil strip line to the distressed soldier. The inner end of this steel strip is disconnected from the hand crank and removed from the launcher. Then the necessary ammunition is clipped to the inner end of the steel strip and retrieved by the first soldier who is in need.

CONCLUSION

The Quick2Save™ Rescue and Retrieval Delivery System has vast application for rescue in water or land situations and will save lives. Time is critical in a rescue situation; Quick2Save™ offers a delivery and retrieval system that can be the difference between life and death. All users of the Quick2Save™ Rescue and Retrieval Delivery System will be trained by either the US Coast Guard or similar agency to ensure that "a first responder is a trained responder".

Reference is made to the following List in which the elements of the present invention are identified by the numerals which appear in the description hereinabove.

| | |
|---|---|
| 10 | Overall Launcher |
| 12 | Launcher Control Chamber |
| 14 | Removable Barrel |
| 16 | Hand Trigger Grip |
| 18 | Telescope |
| 20 | Telescope Mount |
| 22 | Screw in $CO_2$ Stop |
| 24 | Trigger |
| 26 | Buoyant Barrel Foam |
| 28 | Buoyant Chamber Foam |
| 30 | Spring Chamber |
| 31 | Release Pin |
| 32 | Butt Stock Mounting Slots |
| 34 | Placement Rod Mount |
| 36 | Canister Placement Rod |
| 38 | Retrieving Chamber |
| 40 | Ribbon Spool Box |
| 42 | Hand Crank |
| 44 | Mounting Rod |
| 46 | Locking Groove |
| 48 | Release Ring |
| 50 | Canister Unit with UFE Jacket |
| 52 | Canister Cup |
| 54 | Life Jacket |
| 56 | Steel Ribbon |
| 58 | Ribbon Life Jacket Connector |
| 60 | Release Pin |
| 62 | Ribbon Spool |
| 64 | Lock Pin |
| 66 | Spring |
| 68 | Trigger Return Spring |
| 70 | Counter Lever |
| 72 | Piercing Head |
| 74 | Rubber Seal |
| 76 | $CO_2$ Cartridge |
| 78 | $CO_2$ Dispersing Chamber |
| 80 | Pressure Face of Canister |
| 82 | Inner Coated Barrel |
| 84 | Butt Stock |
| 86 | Butt Stock Pad |
| 88 | Jacket Ribbon Half Mount |
| 90 | Ribbon Half Mount |
| 92 | Key Slots Rivets |
| 94 | Ribbon Spool |
| 96 | Ribbon Spool Shaft |
| 98 | $CO_2$ Cartridge Membrane |
| 100 | Trigger Finger |
| 102 | Door |
| 104 | Slide Lock Bolt |
| 105 | Slide Lock |
| 106 | Retrieving Spool |
| 108 | Camming Slots |
| 110 | Camming Pin |
| 112 | Return Spring |
| 114 | Ribbon Spool One Way Locking Cams |
| 116 | Retrieving Spool Locking Cams |
| 118 | Retrieving Spool One Way Locking Cams |
| 120 | Ribbon Box Locking Cams |
| 122 | Ribbon Spool Locking Tab |
| 124 | Shaft Support Mount |
| 126 | Ribbon Box Mount |
| 128 | Retrieving Spool Inner Face |
| 130 | Retrieving Spool Outer Face |
| 132 | Tripod Stand |
| 134 | Spring Stop |
| 136 | Ribbon Box Mount Groove |
| 138 | Ribbon Channel |
| 140 | Key Slots |
| 142 | Lock Pin Hole |
| 144 | Victim |
| 146 | Mailbox-Type Ribbon Slots |
| 148 | Door Hinge |
| 150 | Hinge Pin |
| 152 | Water Drain Holes |
| 154 | Compressed Gas Tank |
| 156 | Release Valve |
| 158 | Pressure Gauge |
| 160 | Gas Line |
| 162 | Gas Line Adapter |

-continued

| | |
|---|---|
| 164 | Foot Pedal Gas Line On-Off Valve |
| 166 | Release Knob |
| 168 | Return Spring |
| 170 | Lock Pin |
| 172 | Spring Stop |
| 174 | Pedal Unit |
| 178 | Inner Clamping Wall |
| 180 | Outer Clamping Wall |
| 182 | Return Spring |
| 184 | Base |
| 186 | O-Ring |
| 188 | Release Rod |
| 190 | Rod Guide and Holder |
| 192 | Rubber Seal |
| 194 | Return Spring |
| 196 | Fixed Plate |
| 198 | Rod Head |
| 200 | Enlarged Ribbon Spool Box |
| 202 | Threaded Canister Cup |
| 204 | Splined Canister Head |
| 206 | Splines |
| 208 | Internal Bundled Emergency Supplies |
| 210 | Water Sensitive Unit |
| 212 | Depression for Pointed Canister Shell |
| 214 | Fire Extinguisher Canister |
| 216 | Weakened Seams |
| 218 | Fire |
| 220 | Fire Extinguishing Substance |
| 222 | Table |
| 224 | Lock Washer |
| 226 | Tight Seal |

The invention claimed is:

1. A delivery system for establishing contact with a predetermined distal location for deployment of a container which contains a fire retardant, which comprises:

a) a launching device including an elongated member having an inner cylindrical opening, said cylindrical opening dimensioned for reception of said container containing said fire retardant;

b) a compressed gas deployment system associated with said launching device and adapted to selectively release compressed gas proximal of said container, for selectively providing force to said container sufficient to deploy said container to the distal location, said compressed gas deployment system including a $CO_2$ (i.e., carbon dioxide gas) cartridge having a pierceable membrane seal at a forward end facing a rearward end of said container, and adapted to be pierced to release compressed $CO_2$ gas; and c) a trigger mechanism having a manually operable trigger device arranged to selectively move a piercing member into engagement with said membrane seal of said CO2 cartridge to activate said cartridge by releasing compressed $CO_2$ gas directly against said rearward end of said container, to thereby provide direct force to said container to deploy said container to said distal location, whereby said fire retardant may be delivered to said distal location.

2. The delivery system according to claim 1, wherein said container containing fire retardant is a canister which is adapted to disperse fire retardant upon impact with said predetermined distal location.

3. The delivery system according to claim 2, wherein said fire retardant containing canister is elongated and includes a plurality of radially outwardly extending splines which engage said inner cylindrical opening of said elongated member.

4. The delivery system according to claim 3, wherein said fire retardant containing canister includes weakened seams which separate upon impact with said distal location to release the fire retardant.

5. The delivery system according to claim 4, wherein said fire retardant canister is generally bullet shaped to improve the delivery range.

6. The delivery system according to claim 1, wherein said inner cylindrical opening of said elongated member has a smooth metal plated surface.

7. A delivery system for establishing contact with a predetermined distal location, which comprises:

a) a launching device including an elongated member having an inner cylindrical opening, said cylindrical opening dimensioned for reception of an object to be deployed;

b) a compressed gas deployment system connected to said launching device; and c) means to selectively release compressed gas proximal of the object, for selectively providing force to the object sufficient to deploy the object to the distal location, wherein said means to selectively release gas proximal of the object comprises an external compressed gas tank and a pedal control unit operatively connected and adapted to selectively release compressed gas from said tank, whereby said compressed gas is directed to a location proximal of said object to permit selective deployment of said object.

8. The delivery system according to claim 7, wherein said inner cylindrical opening of said elongated member has a smooth metal plated surface.

9. A delivery system for establishing contact with a pre-determined distal location for deployment of an elongated canister which contains a fire retardant, which comprises:

a) a launching device including an elongated member having an inner cylindrical opening dimensioned for reception of said canister containing said fire retardant;

b) a compressed gas deployment system associated with said launching device and adapted to selectively release compressed gas proximal of said canister, for selectively providing force to said canister sufficient to deploy said canister to said distal location, said compressed gas deployment system including a $CO_2$ (i.e., carbon dioxide gas) cartridge having a pierceable membrane seal at a forward end and directly facing a rearward end of said canister, said membrane seal adapted to be pierced to release compressed $CO_2$ gas; and c) a trigger mechanism having a manually operable trigger device arranged to selectively move a piercing member into engagement with said membrane seal of said $CO_2$ cartridge to activate said cartridge by releasing compressed $CO_2$ gas directly against said rearward end of said canister, to thereby provide force to said canister to deploy said canister to said distal location, whereby said fire retardant may be delivered to said distal location.

10. The delivery system according to claim 9, wherein said inner cylindrical opening of said elongated member has a smooth metal plated surface.

11. The delivery system according to claim 10, wherein said fire retardant canister includes a plurality of radially outwardly extending splines which contact said smooth metal plated surface of said inner cylindrical opening of said elongated member to reduce the contact surface with said smooth metal plated surface.

12. The delivery system according to claim 11, wherein said fire retardant canister includes weakened seams which separate upon impact with said distal location to release fire retardant.

13. A delivery system for establishing contact with a predetermined distal location for deployment of an elongated bullet shaped canister which contains a fire retardant, which comprises:

a) a launching device including an elongated member having an inner cylindrical opening, said cylindrical opening dimensioned for reception of said canister containing said fire retardant;

b) a compressed gas deployment system associated with said launching device, for selectively releasing the compressed gas directly against a rearward end of said canister to provide force to said canister sufficient to deploy said canister to said distal location; and c) a device for selectively releasing a supply of the compressed gas to said rearward end of said canister.

14. The delivery system according to claim 13, wherein said compressed gas deployment system comprises an external compressed gas tank system operatively connected and adapted to selectively release compressed gas proximal of said canister.

15. The delivery system according to claim 14, wherein said external compressed gas tank system comprises a tank of compressed gas and a pedal control unit operatively connected and adapted to selectively release compressed gas from said tank, whereby said compressed gas is directed to a location proximal of said canister to permit selective deployment of said canister.

16. The delivery system according to claim 15, further comprising a sight scope mounted atop said elongated member to facilitate distance viewing by the user of the distal location to provide accuracy in deployment of said canister.

17. The delivery system according to claim 16, wherein said elongated member of said launching device is comprised of sections which are releaseably attachable to each other to permit selective adjustment of the length of said elongated member.

18. The delivery system according to claim 13, wherein said compressed gas deployment system comprises:

a) a $CO_2$ (i.e., carbon dioxide gas) cartridge having a piercable membrane seal at a forward end facing a rearward end of said fire retardant canister; and b) a device which permits selective piercing of said membrane seal to selectively release compressed $CO_2$ gas directly against said rearward end of said fire retardant canister.

19. The delivery system according to claim 18, wherein said device which permits selective piercing of said membrane seal of said $CO_2$ cartridge is a trigger mechanism having a manually operable trigger device arranged to selectively move a piercing member into engagement with said membrane seal of said $CO_2$ cartridge.

20. The delivery system according to claim 13, wherein said inner cylindrical opening of said elongated member has a smooth metal plated surface.

21. The delivery system according to claim 20, wherein said fire retardant canister includes a plurality of radially outwardly extending splines which contact said smooth metal plated surface of said inner cylindrical opening of said elongated member to reduce the contact surface with said smooth metal plated surface.

22. The delivery system according to claim 21, wherein said fire retardant canister includes weakened seams which separate upon impact with said distal location to release fire retardant.

23. A rescue and delivery system for deploying an object to a predetermined distal location, and optionally retrieving same, which comprises:

a) a launching device including an elongated member having an inner cylindrical opening having a generally smooth surface, said cylindrical opening dimensioned for reception of the object to be deployed;

b) a compressed gas deployment system associated with said launching device, for selectively providing force to the object sufficient to deploy the object to the distal location;

c) a reel device attached to said launching device and having a manually rotatable reel member;

d) an elongated flexible member extending into said cylindrical opening and having means at the free distal end for releasable attachment to the object, a proximal end of said elongated flexible member being attached to said rotatable reel member and wound therearound, and upon itself; and e) a device for selectively releasing compressed gas to the object.

24. The rescue and delivery system according to claim 23, wherein said compressed gas deployment system comprises an external compressed gas tank system.

25. The rescue and delivery system according to claim 24, wherein said external compressed gas tank system comprises a tank of compressed gas and a pedal control unit operatively connected and adapted to selectively release compressed gas from said tank, whereby said compressed gas is directed to a location proximal of the object to permit selective deployment of the object.

26. The delivery system according to claim 25, further comprising a sight scope mounted atop said elongated member to facilitate long distance viewing by the user of the distal location to provide accuracy in deployment of said canister.

27. The delivery system according to claim 26, wherein said elongated member of said launching device is comprised of sections which are releaseably attachable to each other to permit selective adjustment of the length of said elongated member.

28. The delivery system according to claim 23, wherein said compressed gas deployment system comprises:

a) a $CO_2$ (i.e., carbon dioxide gas) cartridge having a piercable membrane seal at a forward end facing a rearward end of said fire retardant canister; and b) a device which permits selective piercing of said membrane seal to selectively release compressed $CO_2$ gas directly against said rearward end of said fire retardant canister.

29. The delivery system according to claim 28, wherein said device which permits selective piercing of said membrane seal of said $CO_2$ cartridge is a trigger mechanism having a manually operable trigger device arranged to selectively move a piercing member into engagement with said membrane seal of said $CO_2$ cartridge.

* * * * *